US006653601B2

(12) United States Patent
Taniguchi et al.

(10) Patent No.: US 6,653,601 B2
(45) Date of Patent: Nov. 25, 2003

(54) CERAMIC HEATER, GLOW PLUG USING THE SAME, AND METHOD FOR MANUFACTURING THE SAME

(75) Inventors: Masato Taniguchi, Aichi (JP); Nobuyuki Hotta, Aichi (JP); Haruhiko Sato, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/135,770

(22) Filed: May 1, 2002

(65) Prior Publication Data

US 2002/0162831 A1 Nov. 7, 2002

(30) Foreign Application Priority Data

May 2, 2001 (JP) ..... 2001-135621

(51) Int. Cl.[7] ..... F23Q 7/00

(52) U.S. Cl. ..... 219/270; 123/145 A; 313/141; 313/143

(58) Field of Search ..... 219/270, 544, 219/267; 361/264, 265, 266; 204/426; 264/618; 123/145 A, 145 R, 143 C; 313/118, 141, 142, 143

(56) References Cited

U.S. PATENT DOCUMENTS 5,750,958 A * 5/1998 Okuda et al. ..... 219/267
6,082,175 A * 7/2000 Yoshikawa et al. ..... 204/426
6,143,238 A * 11/2000 Konishi et al. ..... 264/618
6,204,481 B1 * 3/2001 Ito ..... 219/270
6,423,944 B2 * 7/2002 Watanabe et al. ..... 219/270
6,433,311 B1 * 8/2002 Teramura et al. ..... 219/270
6,563,089 B2 * 5/2003 Watanabe et al. ..... 219/270

FOREIGN PATENT DOCUMENTS

JP 3044632 3/2000
JP 2000-130754 5/2000

* cited by examiner

*Primary Examiner*—Teresa Walberg
*Assistant Examiner*—Fadi H. Dahbour
(74) *Attorney, Agent, or Firm*—Sughrue Mion, PLLC

(57) ABSTRACT

A ceramic heater 1 is configured such that a ceramic resistor 10 includes a first resistor portion 11, which is disposed at a front end portion of a heater body 2, and which is formed of a first electrically conductive ceramic, and a pair of second resistor portions 12, which are disposed on the rear side of the first resistor portion 11 so as to extend along the direction of the axis O of the heater body 2. The front end parts of the second resistor portions 12 are joined to corresponding end parts of the first resistor portion 11 as viewed along the direction of electricity supply. The second resistor portions are formed of a second electrically conductive ceramic having an electrical resistivity that is lower than that of the first electrically conductive ceramic. At least a portion of a joint interface 15 between the first resistor portion 11 and each of the second resistor portions 12 deviates from a transverse plane P that perpendicularly intersects the axis O of the heater body 2. The joint interface 15 is formed of planes that perpendicularly intersect a reference plane K including the respective axes J of the second resistor portions 12.

18 Claims, 18 Drawing Sheets

39
39a
36
34b
37

34b
39'
37
36
39a

J
70
13

1
2
13

CERAMIC HEATER, GLOW PLUG USING THE SAME, AND METHOD FOR MANUFACTURING THE SAME

BACKGROUND OF THE INVENTION

1. Field of the Invention

The present invention relates to a ceramic heater to be used in a glow plug for preheating a diesel engine or in a like device, to a method for manufacturing the same, and to a glow plug using the same.

2. Description of the Related Art

A conventionally known ceramic heater for the above-mentioned applications is configured such that a resistance-heating member formed of an electrically conductive ceramic is embedded in an insulating ceramic substrate. In such a ceramic heater, electricity is supplied to the resistance-heating member via metallic leads formed of tungsten or a like metal. However, use of the metallic leads involves a corresponding increase in the number of components, possibly resulting in an increase in the number of manufacturing steps and thus an increase in cost. In order to cope with the problem, Japanese Patent No. 3044632 discloses an all-ceramic-type heater structure in which (1) a first resistor portion serves as a major resistance-heating portion, and (2) a second resistor portion, which is formed of an electrically conductive ceramic having electrical resistivity lower than that used to form the first resistor portion, serves as an electricity conduction path to the first resistor portion. This structure eliminates the use of metallic leads.

The integration of resistor portions that have different electrical resistivities facilitates implementation of a ceramic heater having a so-called self-saturation-type heat generation characteristic. These ceramic heaters function in the following manner. At an initial stage of electricity supply, a large current flows to the first resistor portion via the second resistor portion, thereby promptly increasing the temperature. And when the temperature rises to be near a target temperature, the current flow is controlled by means of an increase in electric resistance of the second resistor portion. Japanese Patent Application Laid-Open (kokai) No. 2000-130754 also discloses this effect as well as a ceramic heater structure in which electricity is supplied, via metallic leads, to a ceramic resistor configured such that two resistor portions of different electrical resistivities are joined together.

In the above-described ceramic heaters, a joint interface between ceramic resistors formed of different materials is inevitably formed. Usually, electrically conductive ceramics that have different electrical resistivities also have considerably different coefficients of linear expansion. Accordingly, in an application involving frequent repetition of temperature rise and cooling (as in the case of a glow plug), thermal stress induced by the above-mentioned difference in coefficient of linear expansion tends to concentrate at the joint interface between the different resistor portions. Particularly, in the case of the structure disclosed in Japanese Patent No. 3044632, in which the resistor portions are joined via a flat interface that is perpendicular to the axis, the area of the joint interface is small, and thus the above-described stress concentration is likely to fracture the resistor along the joint interface. To cope with this drawback, Japanese Patent Application Laid-Open (kokai) No. 2000-130754 proposes a structure in which a circular recess is formed on an end part of the first resistor portion, and a protrusion is formed on an end part of the second resistor portion so as to be fitted into the recess, thereby increasing the area of the joint interface and thus enhancing the strength of the joint.

Although the conventional ceramic heaters are generally thought to be acceptable, they are not without shortcomings. These shortcomings include the following. (1) Since the protrusion and the recess must be formed independently on the corresponding joint interfaces, when the resistor is to be formed through injection molding and firing, the two resistor portions must be formed independently of each other by use of completely different molds, potentially resulting in an increase in the number of manufacturing steps and mold cost. Moreover, a mold for forming the resistor portion on which the recess is to be formed must be combined with a core for forming the recess which can move toward and away from the mold; therefore, the mold is likely to become expensive.

(2) The conventionally-configured ceramic resistor generates heat such that temperature is high at a front end part of the first resistor portion and drops rearward along the axial direction. Thus, a steep temperature gradient is likely to be developed along the axial direction (the joining direction) between the first resistor portion, which generates a relatively high amount of heat, and the second resistor portion, which is at a relatively low temperature. In the ceramic heater disclosed in the above-mentioned publication, the cross-sectional ratio between the first resistor portion and the second resistor portion, which are formed from different kinds of ceramic, changes abruptly in a stepwise fashion at a joint where the protrusion and the recess are engaged. Therefore, when the above-mentioned temperature gradient arises, the effect of alleviating thermal stress concentration at the joint cannot be expected to be strong.

SUMMARY OF THE INVENTION

A first object of the present invention is to provide a ceramic heater that can be manufactured at low cost. The ceramic heater has a ceramic resistor in the form of a joined body consisting of different kinds of resistor portions. A second object of the present invention is to provide a ceramic heater in which a joint portion between different kinds of resistor portions exhibits excellent strength and durability. The present invention also provides a glow plug using such a ceramic heater.

A ceramic heater of the present invention includes a rodlike heater body which is configured such that a ceramic resistor formed of an electrically conductive ceramic is embedded in a ceramic substrate formed of an insulating ceramic. The heater body is also configured such that the ceramic resistor comprises a first resistor portion, which is disposed at a front end portion of the heater body and formed of a first electrically conductive ceramic, and a pair of second resistor portions, which are disposed on the rear side of the first resistor portion in such a manner as to extend along the direction of the axis of the heater body, whose front end parts are joined to corresponding end parts of the first resistor portion as viewed along the direction of electricity supply. The second resistor portions are formed of a second electrically conductive ceramic having an electrical resistivity that is lower than that of the first electrically conductive ceramic. The ceramic resistor assumes the form of a joined body consisting of resistor portions of different resistivities, for a reason similar to that described previously in relation to the conventional ceramic heaters.

To achieve the above-described first object, a first configuration of a ceramic heater according to the present invention includes at least a portion of a joint interface between the first resistor portion and the second resistor portion being deviated from a plane perpendicularly intersecting the axis of the heater body, and the joint interface is formed of a plane, a curved surface, or a combination thereof perpendicularly intersecting a reference plane defined as a plane including the axis of the heater body and the axis of the second resistor portion.

Since at least a portion of the joint interface between the resistor portions deviates from a plane perpendicularly intersecting the axis of the heater body, the area of the joint is increased as compared with the case where the joint interface assumes a simple plane perpendicularly intersecting the axis of the heater body, thereby enhancing the joining strength of the two resistor portions. With a plane including the axes of the second resistor portions being defined as a reference plane, the joint interface is formed of a plane, a curved surface, or a combination thereof perpendicularly intersecting the reference plane, thereby yielding the following advantage. When the ceramic resistor is manufactured through injection molding; specifically, by an insert molding process in which a green body of one resistor portion serves as an insert, and the other resistor portion is integrated with the insert through insert molding, mold sharing can be implemented, and the manufacturing process can be greatly simplified, thereby greatly reducing manufacturing cost.

The present invention provides a specific method for manufacturing a ceramic heater. The method comprises the steps of manufacturing a ceramic green body and firing the ceramic green body in order to manufacture the heater body. The ceramic green body comprising a green body, which is to become the ceramic substrate, and a resistor green body, which is embedded in the green body and is to become the ceramic resistor. In manufacture of the ceramic green body, the resistor green body is manufactured through injection molding, and in order to carry out the injection molding, a split mold having an injection cavity for molding the resistor green body is prepared. The split mold comprises a first mold and a second mold. The injection cavity is divided into a cavity formed in the first mold and a cavity formed in the second mold, along a dividing plane corresponding to the reference plane. The second mold has a second integral injection cavity formed therein. The second integral injection cavity integrally comprises a cavity corresponding to the first resistor portion, and a cavity corresponding to the second resistor portion. A preliminary-molding mold and an insert-molding mold are prepared to serve as a first mold. The preliminary-molding mold has a partial injection cavity formed therein for molding a preliminary green body, which is to become either the first resistor portion or the second resistor portion. The preliminary-molding mold comprises a filler portion for filling, when mated with the second mold, a portion of the second integral injection cavity which is not used for molding the preliminary green body. The filler portion has an adjacent face adjacent to the partial injection cavity and perpendicular to the dividing plane. The insert-molding mold has a first integral injection cavity formed therein. The first integral injection cavity integrally comprises a cavity corresponding to the first resistor portion, and a cavity corresponding to the second resistor portion.

The second mold and the preliminary-molding mold are mated with each other, and a molding compound is injected to thereby mold the preliminary green body. Next, the second mold and the insert-molding mold are mated with each other while the preliminary green body is disposed as an insert in the corresponding cavity portions of the first integral injection cavity and the second integral injection cavity, and a molding compound is injected into the remaining cavity portions to thereby yield the resistor green body through integration of an injection-molded portion with the preliminary green body.

The above-described method uses a split mold as an injection mold for forming a ceramic resistor as in the case of ordinary injection molding. The ceramic resistor; i.e., the first resistor portion and the two second resistor portions extending in the same direction from the corresponding ends of the first resistor portion and serving as electricity conduction paths, assumes a shape peculiar to a ceramic heater to which the present invention is applied, such as a shape resembling the letter U or a shape resembling the letter C. When the ceramic resistor (resistor green body) in such a form is to be formed through injection molding, a plane including the respective axes of the two second resistor portions is defined as a reference plane and is used as a dividing plane for dividing an injection cavity formed in a mold, thereby facilitating the removal of an injection-molded body from the mold.

The method of the present invention employs an insert molding process in which either the first resistor portion or the second resistor portion is formed beforehand as a preliminary green body, and the preliminary green body is integrated with the other resistor portion(s) through insert molding. A single second mold and two first molds are prepared to form a split mold for use in the insert molding. The second mold has a second integral injection cavity formed therein. The second integral injection cavity integrally comprises a cavity corresponding to the first resistor portion, and a cavity corresponding to the second resistor portion. The second mold is used in common in forming the preliminary green body and insert molding. The two first molds are a preliminary-molding mold for forming a preliminary green body and a regular mold for use in insert molding. The preliminary-molding mold has a partial injection cavity formed therein for molding the preliminary green body and comprises a filler portion for filling a portion of the second integral injection cavity which is not used for molding the preliminary green body, whereby the preliminary green body can be rationally formed merely by using a necessary portion of the second integral injection cavity. The joint interface between the first resistor portion and the second resistor portion assumes the form of a plane, a curved surface, or a combination thereof perpendicularly intersecting the above-mentioned reference plane; i.e., the dividing plane for dividing an injection mold cavity, whereby the mold can be readily opened without inflicting damage to the preliminary green body, by separating the preliminary-molding mold from the second mold in a direction perpendicular to the above-mentioned dividing plane. That is, as a result of the above-described shape of the joint interface, an end face of the preliminary green body which is to become the joint interface; i.e., the contact face between the preliminary green body and the filler portion (i.e., an adjacent face adjacent to the filler portion and the partial injection cavity), becomes parallel with the mold opening direction, thereby avoiding interference between the locus of the moving filler portion and the preliminary green body in the course of the mold opening.

After mold opening, while the preliminary green body is left in the same second mold, the first mold is replaced with the regular mold, followed by insert molding to thereby integrally mold the remaining portion. In this manner, the resistor green body can be readily obtained, and the second mold can be used in common for preliminary molding and regular molding (insert molding) to thereby reduce mold cost. That is, while assuming the form of a joined body consisting of resistor portions of different kinds, the ceramic resistor can be manufactured at low cost, thereby achieving the first object of the present invention.

To achieve the above-described second object, a second configuration of a ceramic heater according to the present invention has the joint interface between the first resistor portion and the second resistor portion mainly (specifically, not less than 50% of the joint interface) formed of an inclined face portion, which is inclined with respect to a plane perpendicularly intersecting the axis of the heater body.

Since the joint interface between the first resistor portion and the second resistor portion includes the above-described inclined face portion, the area of the joint is increased as compared with the case where the joint interface assumes a simple plane perpendicularly intersecting the axis of the heater body, thereby enhancing the joining strength of the two resistor portions. Also, the inclined face portion is simple in shape as compared with, for example, a protrusion-recess-fitting face, thereby reducing mold cost in forming the resistor portions by injection molding or a similar process. Since the joint interface assumes a simple shape, for example, when either the first resistor portion or the second resistor portion is formed beforehand as a preliminary green body, and the preliminary green body is integrated with the other resistor portion(s) through insert molding, a molding compound is favorably distributed along the joint interface. As a result, the joint interface becomes unlikely to suffer a defect, such as remaining bubbles.

Since, at the inclined face portion, the distribution ratio between a ceramic of the first resistor portion and that of the second resistor portion changes gradually along the axial direction of the heater body, even when a great temperature gradient arises along the axial direction, a joint portion is unlikely to suffer thermal stress concentration. Therefore, even when the heater is subjected to repeated thermal shock or a like condition, the joint portion can maintain good durability. In this manner, the second object is achieved.

Preferably, to enhance the above-described effect, the joint interface between the first resistor portion and the second resistor portion is entirely formed of the inclined face portion. However, in this case, for example, in manufacture of the ceramic resistor by the aforementioned insert molding process, an end face of the preliminary green body which is to become the joint interface includes a sharp end portion. As a result, chipping or a similar problem is likely to occur. In order to prevent the problem, an end portion of the joint interface may assume the form of a gently inclined face or a face perpendicularly intersecting the axis of the heater body.

The above-described first configuration and second configuration of a ceramic heater of the present invention may be combined with each other. In this case, the aforementioned first and second objects can be simultaneously achieved.

A glow plug of the present invention includes the above-described ceramic heater of the present invention; a metallic sleeve disposed in such a manner as to circumferentially surround the heater body of the ceramic heater and such that a front end portion of the heater body projects therefrom along the direction of the axis; and a metallic shell joined to a rear end portion of the metallic sleeve as viewed along the direction of the axis and having a mounting portion formed on an outer circumferential surface thereof, the mounting portion being adapted to mount the glow plug onto an internal combustion engine. Employment of the ceramic heater of the present invention can realize a glow plug exhibiting excellent durability at low cost.

In the claims appended hereto, the reference numerals associated with the recited components are cited from the accompanying drawings for a fuller understanding of the nature of the present invention, but they should not be construed as limiting the concept of the components in the claims.

The above and other features of the invention including various and novel details of construction, combination of parts, and method steps will now be more particularly described with reference to the accompanying drawings and pointed out in the claims. It will be understood that the particular ceramic heater, glow plug, and fabrication method embodying the invention is shown by way of illustration only and not as a limitation of the invention. The principles and features of this invention may be employed in varied and numerous embodiments without departing from the scope of the invention.

DESCRIPTION OF REFERENCE NUMERALS

Figure 1:
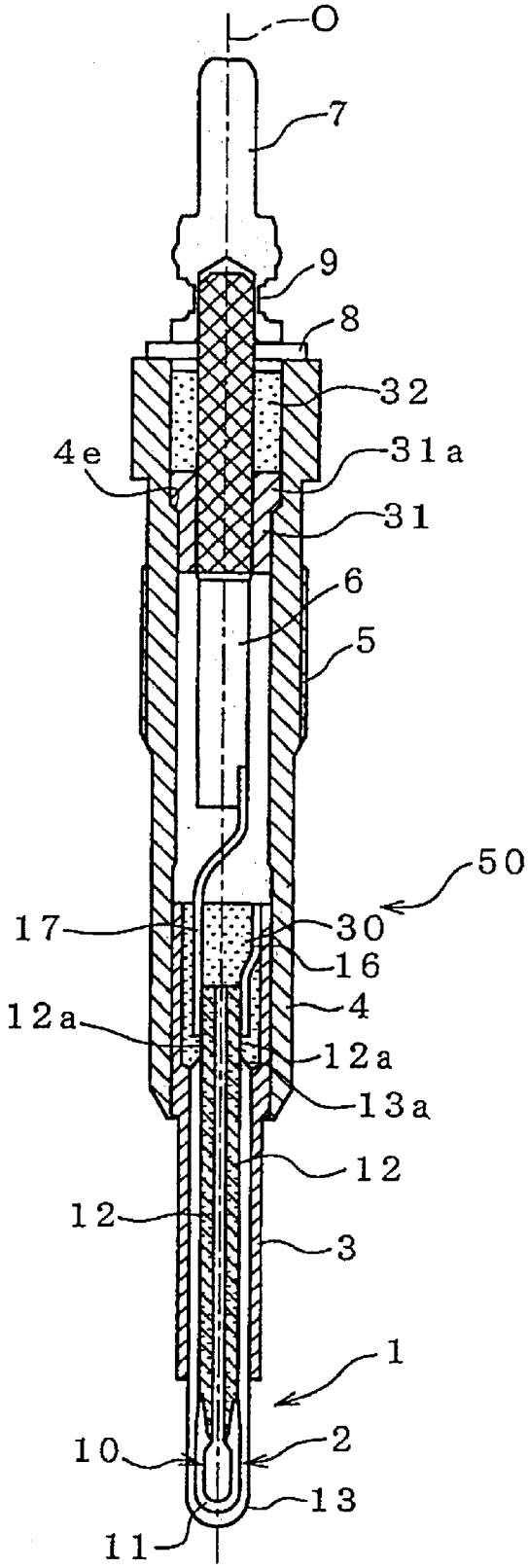
FIG. 1 is a vertical sectional view showing an embodiment of a glow plug of the present invention.

1: ceramic heater
2: heater body
3: metallic sleeve
3*f:* front end edge
4: metallic shell
10: ceramic resistor
11: first resistor portion
12, 12: second resistor portion
12*a,* 12*a:* exposed part
13: ceramic substrate
13*a:* cut portion
15: joint interface
15*t:* inclined face portion
K: reference plane
34: resistor green body
34*b:* preliminary green body
36, 37: green body
DP: dividing plane
50: glow plug
50A: preliminary-molding mold
50B: insert-molding mold
51: second mold
55: cavity for molding first resistor portion
56: cavity for molding second resistor portion
57: second integral injection cavity
58: partial injection cavity
59: adjacent face
60: filler portion
61: cavity for molding first resistor portion
62: cavity for molding second resistor portion
CP1, CP2: molding compound
115: prospective joint face
115*c:* recess

DETAILED DESCRIPTION OF THE INVENTION

Illustrative, non-limiting embodiments of the present invention will next be described with reference to the accompanying drawings. However, the present invention shall not be construed as being limited thereto.

FIG. 1 shows an example of a glow plug using a ceramic heater of the present invention. The glow plug 50 includes a ceramic heater 1, a metallic sleeve 3, which surrounds an outer circumferential surface of a heater body 2 of the ceramic heater 1 such that an end portion of the heater body 2 projects therefrom, and a cylindrical metallic shell 4, which surrounds the metallic sleeve 3. A male-threaded portion 5 is formed on the outer circumferential surface of the metallic shell 4 to serve as a mounting portion for mounting the glow plug 50 onto an engine block (not shown). The metallic shell 4 is fixedly attached to the metallic sleeve 3 by brazing, for example, in such a manner as to fill a clearance between the inner and outer circumferential surfaces of the two components. The metallic shell 4 and metallic sleeve 3 may also be fixed together by laser-beam welding along the entire circumference of an inner edge of an opening end of the metallic shell 4 and the outer circumferential surface of the metallic sleeve 3.

Figure 2:
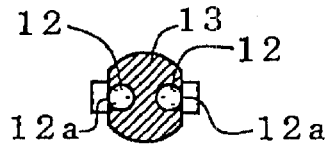
FIG. 2(*b*) is an enlarged vertical sectional view showing a ceramic heater of the embodiment and FIG. 2(*a*) is sectional view taken along line 2—2 of FIG. 2(*b*)
Figure 2:
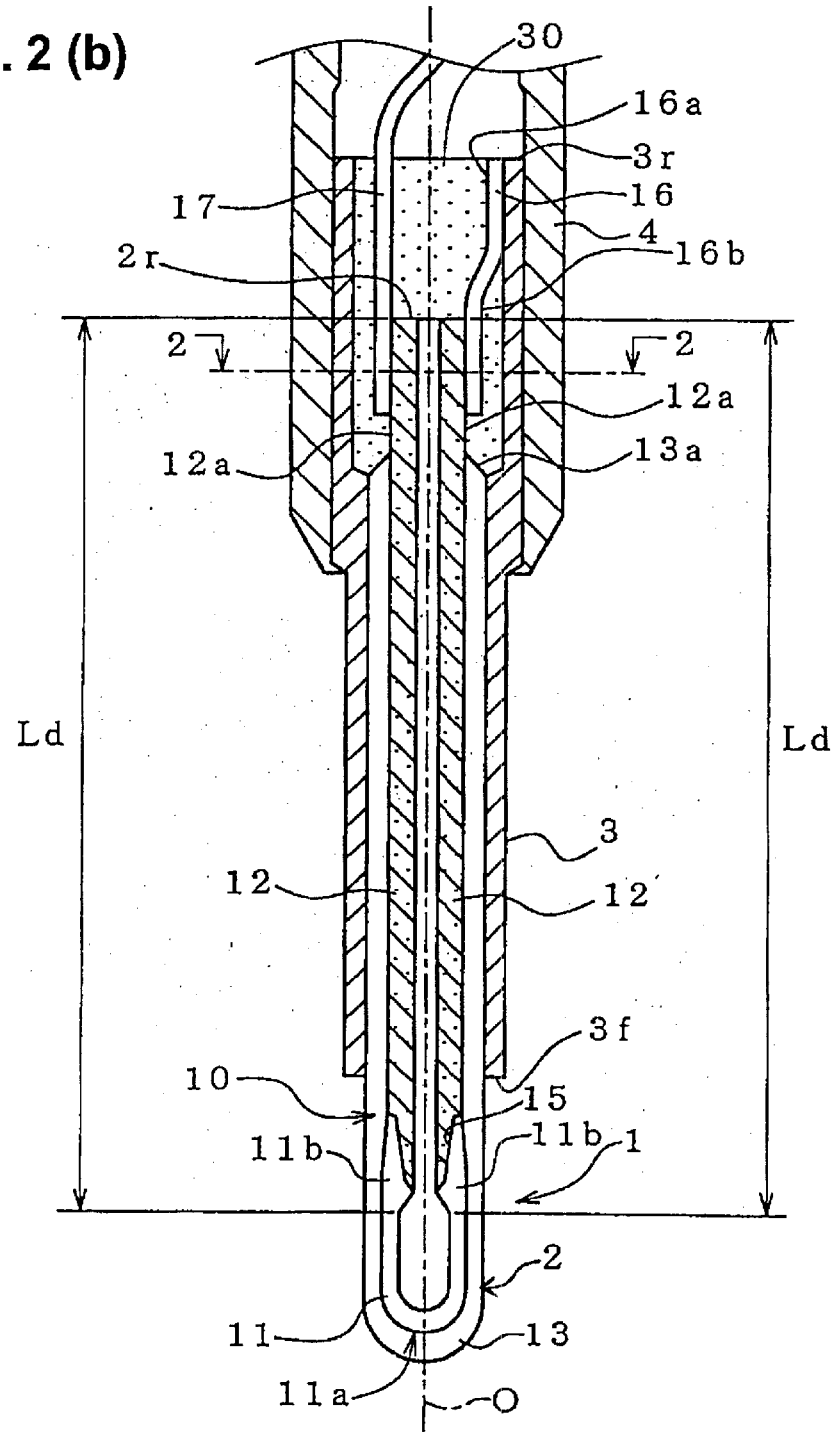

FIG. 2(*b*) is an enlarged vertical sectional view of the ceramic heater 1, and FIG. 2(*a*) is a sectional view taken along the line 2–2 of FIG. 2(*b*). The heater body 2 assumes a rodlike form and is configured such that a ceramic resistor 10, which is formed of an electrically conductive ceramic, is embedded in a ceramic substrate 13, which is formed of an insulating ceramic. The ceramic resistor 10 includes a first resistor portion 11 and a pair of second resistor portions 12. The first resistor portion 11 is located at a front end portion of the heater body 2, and is formed of a first electrically conductive ceramic. The pair of second resistor portions 12 are disposed on the rear side of the first resistor portion 11, and extend along the direction of the center axis O of the heater body 2. Front end parts of the second resistor portions 12 are joined to corresponding end parts of the first resistor portion 11, as viewed along the direction of electricity supply. The second resistor portions 12 are formed of a second electrically conductive ceramic. The second electrically conductive ceramic of the second resistor portions 12 has an electrical resistivity that is lower than that of the first electrically conductive ceramic of the first resistor portion 11.

The present embodiment employs silicon nitride ceramic as the insulating ceramic used to form the ceramic substrate 13. Silicon nitride ceramic assumes a microstructure such that main-phase grains, which contain a predominant amount of silicon nitride (Si3N4), are bonded by means of a grain boundary phase, which is derived from a sintering aid component (described later), or a like component. The main phase may be such that a portion of Si or N atoms are substituted by Al or O atoms, and may contain metallic atoms, such as Li, Ca, Mg, and Y, in the form of a solid solution. Examples of silicon nitride that have undergone such substitution include sialons represented by the following formulas:

β-sialon: $Si_{6-z}Al_zO_zN_{8-z}$ (z=0 to 4.2); and

α-sialon: $M_x(Si,Al)_{12}(O,N)_{16}$ (x=0 to 2).

M: Li, Mg, Ca, Y, R (R represents rare-earth elements excluding La and Ce)

Silicon nitride ceramic can contain, as a cation element, at least one element selected from the group consisting of Mg and elements belonging to Groups 3A, 4A, 5A, 3B (e.g., Al), and 4B (e.g., Si) of the Periodic Table. These elements are present in a sintered body in the form of oxides, in an amount of 1–10% by mass as reduced to an oxide thereof and as measured in a sintered body. These components are added mainly in the form of oxides and are present in a sintered body mainly in the form of oxides or composite oxides, such as silicate. When the sintering aid component content is less than 1% by mass, an obtained sintered body is unlikely to become dense. When the sintering aid component content is in excess of 10% by mass, strength, toughness, or heat resistance becomes insufficient. Preferably, the sintering aid component content is 2–8% by mass. Rare-earth components to be used as sintering aid components are Sc, Y, La, Ce, Pr, Nd, Sm, Eu, Gd, Tb, Dy, Ho, Er, Tm, Yb, and Lu. Particularly, Tb, Dy, Ho, Er, Tm, and Yb can be used favorably, since they have the effect of promoting crystallization of the grain boundary phase and improving high-temperature strength.

Next, as mentioned previously, the first resistor portion 11 and the second resistor portions 12, which constitute a resistance-heating member 10, are formed of electrically conductive ceramics of different electrical resistivities, respectively. No particular limitations are imposed on a method for differentiating the respective electrical resistivities of the two electrically conductive ceramics. Exemplary methods include: (1) a method in which the same electrically conductive ceramic phase is used, but its content is rendered different; (2) a method in which electrically conductive ceramic phases of different electrical resistivities are employed; and (3) a method in which the previous two methods (i.e., (1) and (2)) are combined. The present embodiment employs method (1).

An electrically conductive ceramic phase can be of a known substance, such as tungsten carbide (WC), molybdenum disilicide ($MoSi_2$), or tungsten disilicide ($WSi_2$). The present embodiment employs WC. To improve thermal-shock resistance through reduction of the difference between the respective linear expansion coefficients of a resistor portion and the ceramic substrate 13, an insulating ceramic phase serving as a main component of the ceramic substrate 13 (i.e., a silicon nitride ceramic phase) can be mixed with the electrically conductive ceramic phase. By changing the content ratio between the insulating ceramic phase and the electrically conductive ceramic phase, the electrically conductive ceramic used to form the resistor portion can be adjusted in electrical resistivity to a desired value.

Specifically, the first electrically conductive ceramic used to form the first resistor portion 11 (which serves as a resistance-heating portion) may contain an electrically conductive ceramic phase in an amount of 10–25% by volume and an insulating ceramic phase as balance. When the electrically conductive ceramic phase content is in excess of 25% by volume, electrical conductivity becomes too high, resulting in a failure to provide a sufficient heating value. On the other hand, when the electrically conductive ceramic phase content is less than 10% by volume, electrical conductivity becomes too low, also resulting in a failure to provide a sufficient heating value.

The second resistor portions 12 serve as electricity conduction paths to the first resistor portion 11. The second electrically conductive ceramic used to form the second resistor portions 12 may contain an electrically conductive ceramic phase in an amount of 15–30% by volume and an insulating ceramic phase as balance. When the electrically conductive ceramic phase content is in excess of 30% by volume, densification through firing becomes difficult to achieve, with a resultant tendency toward insufficient strength. Additionally, an increase in electrical resistivity becomes insufficient (even when a temperature region which is usually used for preheating an engine is reached), potentially resulting in a failure to yield a self-saturation function for stabilizing current density. On the other hand, when the electrically conductive ceramic phase content is less than 15% by volume, heat generation of the second resistor portions 12 becomes excessive, with a resultant impairment in heat generation efficiency of the first resistor portion 11. Preferably, to sufficiently yield the above-mentioned self-saturation function of flowing current, the electrically conductive ceramic phase content V1 (% by volume) of the first electrically conductive ceramic and the electrically conductive ceramic phase content V2 (% by volume) of the second electrically conductive ceramic are adjusted such that V1/V2 is about 0.5–0.9. In the present embodiment, the WC content of the first electrically conductive ceramic is 16% by volume (55% by mass), and the WC content of the second electrically conductive ceramic is 20% by volume (70% by mass). Both of the first and the second electrically conductive ceramics contain silicon nitride ceramic (including a sintering aid) as balance.

In the present embodiment, the ceramic resistor 10 is configured in the following manner. The first resistor portion 11 assumes the shape resembling the letter U, and a bottom portion of the U shape is positioned in the vicinity of the front end of the heater body 2. The second resistor portions 12 assume a rodlike shape and extend rearward along the direction of the axis O, substantially in parallel with each other, from the corresponding end portions of the U-shaped first resistor portion 11.

To cause current to intensively flow to a front end part 11*a* of the first resistor portion 11, which must assume the highest temperature during operation, the first resistor portion 11 is configured such that the front end part 11*a* has a diameter that is smaller than that of the opposite end parts 11*b*. A joint interface 15 between the first resistor portion 11 and each of the second resistor portions 12 is formed at each of the opposite end parts 11*b*. Each of the opposite end parts 11*b* has a diameter that is greater than that of the front end part 11*a*. The area of a transverse cross section taken perpendicularly to the axis of each of the second resistor portions 12 is greater than the cross-sectional area of the front end part 11*a* of the first resistor portion (herein the cross-sectional area is defined as the area of a cross section taken along a plane perpendicularly intersecting a reference plane K, which will be described later). That is, the U-shaped ceramic resistor 10 is configured in the following manner. Two large-diameter rodlike portions Ld, whose diameter is greater than that of the U-shaped front end part 11*a* of the ceramic resistor 10, are connected to the corresponding ends of the front end part 11*a* and serve as electricity conduction paths to the front end part 11*a*. The joint interfaces 15 between the first resistor portion 11 and the second resistor portions 12 are formed at the corresponding large-diameter portions Ld.

As described previously, the joint interfaces 15 exist between the resistor portions formed of different ceramic materials. Accordingly, in an application involving frequent repetition of temperature rise and cooling (e.g., as in the case of a glow plug), thermal stress induced by the difference between the respective coefficients of linear expansion of the two ceramics tends to concentrate at the joint interfaces 15. However, by forming the joint interfaces 15 at the respective large-diameter rodlike portions Ld, the area of the joint is increased, and thus the margin for strength against thermal stress concentration can be increased, whereby a ceramic heater having excellent durability can be realized. Positioning of the joint interface 15 at the large-diameter rodlike portion Ld means that at least the joint interface 15 is not formed at the small-diameter front end part 11*a*. Therefore, the distance between the joint interface 15 and the front end position of the ceramic resistor 10, where temperature rises to the highest level by heat generation, can be increased. This increased distance restrains the joint interface 15 from being subjected to an excessively great temperature gradient and heating-cooling cycles of great temperature hysteresis.

The joint interface 15 of the present embodiment further has the following two features.

Figure 4:
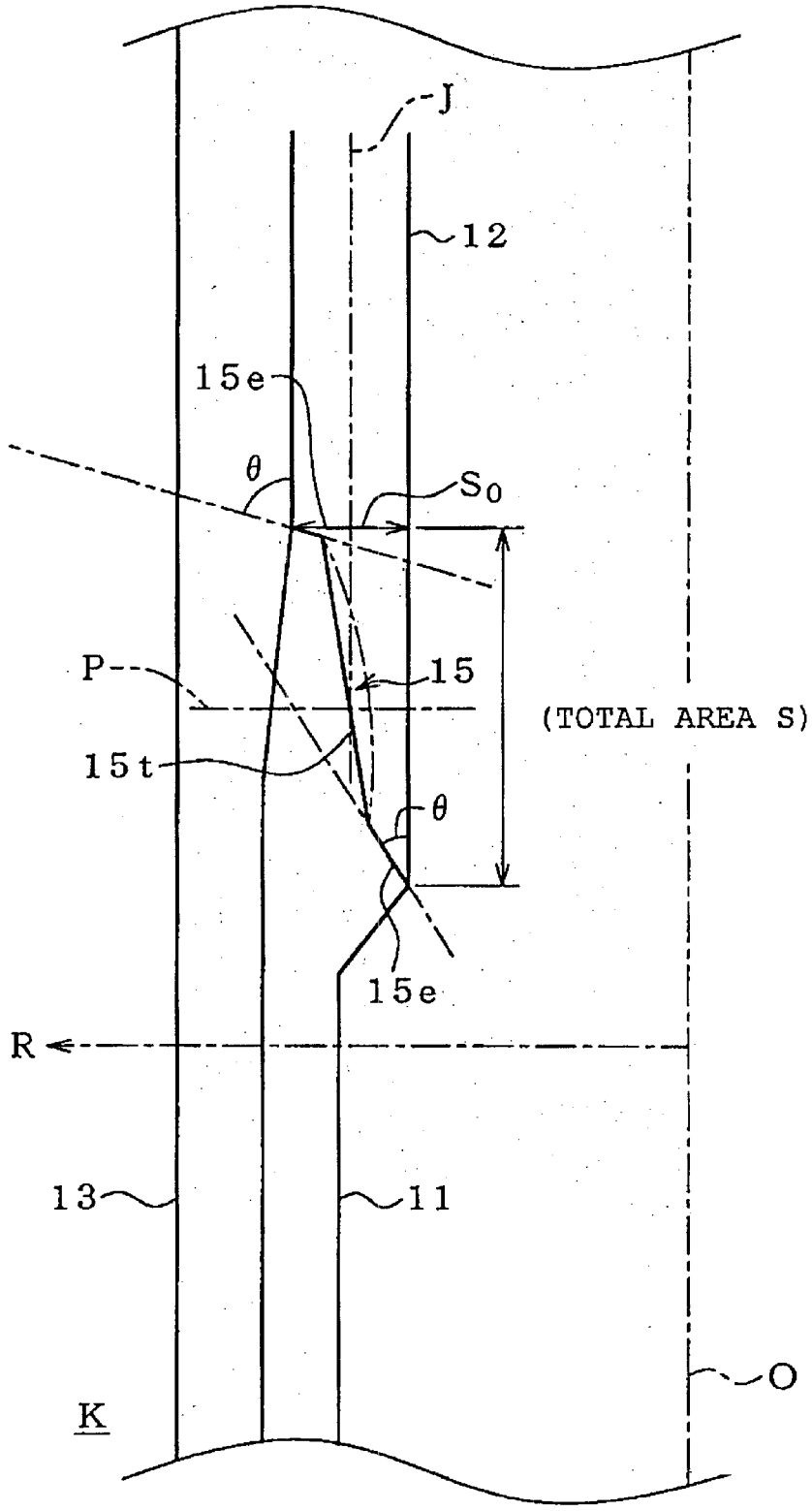
FIG. 4 is an enlarged sectional view showing the joint interface of the glow plug of FIG. 1.

(1) As shown in FIG. 4, the joint interface 15 includes a surface that deviates from a transverse plane P, which perpendicularly intersects the center axis O of the heater body 2. That is, the joint interface 15 includes a facial region that does not perpendicularly intersect the axis O, thereby expanding the area of the joint. Further, when a plane including the respective axes J of the second resistor portions 12 and the center axis O of the heater body 2 is defined as the reference plane K, the joint interface 15 is formed of planes 15*t* and 15*e* perpendicularly intersecting the reference plane K, for the convenience of a production process to be described later. In the present embodiment, the axis O of the heater body 2 is present on the reference plane K. A part of the second resistor portion 12 other than a joint portion (described later), assumes the form of a cylinder having an elliptic cross section. The axis J is defined as a line passing through geometrical centers of gravity of arbitrary cross sections of the elliptic cylinder portion perpendicularly intersecting the direction of extension of the elliptic cylinder portion.

(2) The joint interface 15 includes the inclined face portion 15*t*, which is inclined with respect to the transverse plane P perpendicularly intersecting the axis O of the heater body 2.

The effect of forming the joint interface as noted in item (1) above will be explained later, along with a manufacturing process. The effect yielded by item (2) above is as follows. Since the inclined face portion 15*t* is a plane that deviates from the transverse plane P (which perpendicularly intersects the axis O of the heater body 2), the area of the joint interface is increased, and the joining strength is enhanced. Since the inclined face portion 15*t* assumes a simple shape, during insert molding (described later), a molding compound is favorably distributed along the joint interface 15. This reduces the occurrence of defects such as bubbles remaining in the joint interface 15. Further, due to the inclination of the face portion 15*t*, the distribution ratio between a ceramic of the first resistor portion 11 and that of the second resistor portion 12 changes gradually along the direction of the axis O of the heater body 2. This gradual change in the distribution ratio reduces thermal stress concentrations in the joint portion. Therefore, the joint portion remains durable, even when the heater is subjected to repeated thermal shock or a like condition.

The joint portion is a section along the direction of the axis O, where the joint interface 15 between the first resistor portion 11 and the second resistor portion 12 is present. Referring to FIG. 4, preferably, the joint portion of the ceramic resistor 10 is arranged, such that S/SO is not less than 1.2 and not greater than 10, where:

S represents the total area of the joint interface 15; and

SO represents the smallest area of the transverse cross sections that perpendicularly intersect the axis O of the heater body 2 at arbitrary positions.

When the S/SO value is less than 1.2, the effect of expanding the joint interface 15 is poor. When the S/SO value is greater than 10, the joint portion becomes long, resulting in an unnecessary increase in the dimension of the ceramic heater 1.

The joint interface 15 may be formed of a single inclined face portion. In this case, however, during the insert molding process (described later), a preliminary green body (which is to be used as an insert) is formed such that the end face thereof becomes the joint interface 15. Consequently, the end face includes sharp end portions, as represented by the dashed line in FIG. 3(*a*), which are likely to chip or suffer from other similar defects. To prevent this problem, the end portions of the joint interface 15 may each assume the form of a gently inclined face 15*e* or a face perpendicularly intersecting the axis J of the second resistor portion 12.

For example, and with reference to FIG. 4, on a section taken along an arbitrary plane including the axis J of the second resistor portion 12, θ represents the crossing angle between an outline of the ceramic resistor 10 and a line representing the joint interface 15. Preferably, a θ value as measured on a section taken along a plane including the axis J (in FIG. 4, the plane is the reference plane K), which minimizes θ, is not less than 20°. Employment of such a θ value prevents the occurrence of chipping (and similar problems) on the above-mentioned green body. It is to be appreciated that when a plane perpendicularly intersecting the axis J is employed, θ assumes a maximum value of 90°.

For simplicity, the inclined face portion 15*t* preferably assumes a planar shape as shown in FIG. 4. However, so long as the effect of an inclined face portion is not impaired, the inclined face portion 15*t* may be curved at a slight radius of curvature (as represented by the dash-and-dot line in FIG. 4), whereby the area of the joint can be further increased.

Referring back to FIG. 2, the pair of second resistor portions 12 of the ceramic resistor 10 have axially rear end parts, which are exposed from the surface of the heater body 2, to thereby form respective exposed parts 12*a*. The exposed parts 12*a* serve as joint regions where electricity-conduction terminal elements 16 and 17 are joined to the ceramic resistor 10. This structure does not require embedment of electricity conduction lead wires in the heater body 2, and allows the heater body 2 to be formed exclusively from ceramic, thereby reducing the number of manufacturing steps. In a structure in which metallic lead wires are embedded in ceramic, when heater drive voltage is applied at high temperature, the metallic lead wires wear down because of an electromigration effect. In the electromigration effect, atoms of the metal, which is used to form the metallic lead wires, are forcibly diffused toward the ceramic upon being subjected to an electrochemical drive force induced by an electric field gradient associated with the voltage application. Worn lead wires (resulting from the electromigration effect) are likely to break, or suffer from other similar problems. By contrast, according to the above-described structure, the electricity-conduction terminal elements 16 and 17 are joined to the exposed parts 12*a* of the second resistor portions 12, which serve as electricity conduction paths. Structures that do not involve embedded metallic lead wires avoid the above-described electromigration phenomenon (and the associated shortcomings).

According to the present embodiment, the ceramic substrate 13 is partially cut off at a rear end portion thereof as viewed along the direction of the axis O of the heater body 2 to thereby form a cut portion 13*a*, where the rear end parts of the second resistor portions 12 are exposed. Thus, the above-described exposed parts 12*a* can be simply formed. Such a cut portion 13*a* may be formed at the stage of a green body or may be formed by grinding or a similar process after firing.

The electricity-conduction terminal elements 16 and 17 are made of metal, such as Ni or an Ni alloy, and are brazed to the corresponding second resistor portions 12 at the exposed parts 12*a*. Since metal and ceramic are to be brazed, preferably, an active brazing filler metal suited for such brazing is used; alternatively, an active metal component is provided on the ceramic for metallization by vapor deposition (or a similar process), and subsequently brazing is performed by use of an ordinary brazing filler metal. An applicable brazing filler metal can be of a known Ag type or Cu type, and an applicable active metal component is one or more elements selected from the group consisting of Ti, Zr, and Hf.

As shown in FIG. 1, a metallic rod 6 for supplying electricity to the ceramic heater 1 is inserted into the metallic shell 4 from a rear end thereof as viewed along the direction of the axis O. The metallic rod 6 is electrically insulated from the metallic shell 4. In the present embodiment, a ceramic ring 31 is disposed between the outer circumferential surface of a rear portion of the metallic rod 6 and the inner circumferential surface of the metallic shell 4. A glass filler layer 32 is formed on the rear side of the ceramic ring 31 to thereby fix the metallic rod 6 in place. A ring-side engagement portion 31*a*, which assumes the form of a large-diameter portion, is formed on the outer circumferential surface of the ceramic ring 31. A shell-side engagement portion 4*e,* which assumes the form of a circumferentially extending stepped portion, is formed on the inner circumferential surface of the metallic shell 4 at a position toward the rear end of the metallic shell 4. The ring-side engagement portion 31*a* is engaged with the shell-side engagement portion 4*e,* to thereby prevent the ceramic ring 31 from slipping axially forward. An outer circumferential surface of the metallic rod 6 in contact with the glass filler layer 32 is knurled by knurling or a similar process. In FIG. 1, the knurled surface of the metallic rod 6 is hatched. A rear end portion of the metallic rod 6 projects rearward from the metallic shell 4, and a metallic terminal member 7 is fitted onto the projecting portion via an insulating bushing 8. The metallic terminal member 7 is fixedly attached to the outer circumferential surface of the metallic rod 6 in an electrically continuous condition by a circumferentially crimped portion 9.

In the ceramic resistor 10, one of the second resistor portions 12 is joined at the exposed part 12*a* thereof to the grounding electricity-conduction terminal element 16 to thereby be electrically connected to the metallic shell 4 via the metallic sleeve 3. The other second resistor portion 12 is joined at the exposed part 12*a* thereof to the power-supply-side electricity-conduction terminal element 17 to thereby be electrically connected to the metallic rod 6. In the present embodiment, the exposed parts 12*a* of the second resistor portions 12 are formed at a rear end portion of the outer circumferential surface of the heater body 2, and the heater body 2 is disposed such that a rear end face 2*r* thereof is located frontward from a rear end face 3*r* of the metallic sleeve 3, as viewed along the direction of the axis O. The grounding metallic lead element 16 is disposed in such a manner as to connect the exposed part 12*a* of the heater body 2 and a rear end portion of the inner circumferential surface of the metallic sleeve 3. A portion of the metallic sleeve 3, which is located rearward from the front end edge of the cut portion 13*a* of the heater body 2, is filled with glass 30. As a result, the grounding electricity-conduction terminal element 16 is substantially entirely embedded in the glass 30, and therefor it is unlikely to suffer from breakage, defective contact, or a similar problem, even when vibrations or other disturbances are imposed thereon. In the present embodiment, the grounding electricity-conduction terminal element 16 is a strap-like metallic member. A front end portion of one side 16*a* of the grounding electricity-conduction terminal element 16 is brazed to the corresponding second resistor portion 12, whereas a rear end portion of an opposite side 16*b* is joined to a rear end portion of the inner circumferential surface of the metallic sleeve 3 by, for example, brazing or spot welding. Thus, the grounding electricity-conduction terminal element 16 can be easily joined.

Figure 9:
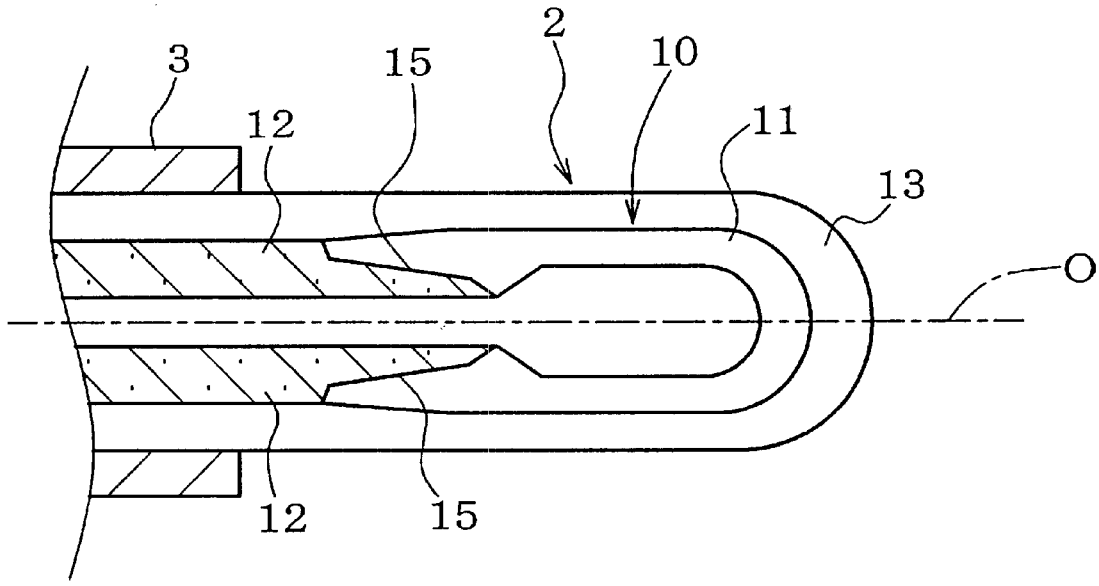
FIG. 9 is a sectional view showing a first modification of the front end portion of the heater body.
Figure 10:
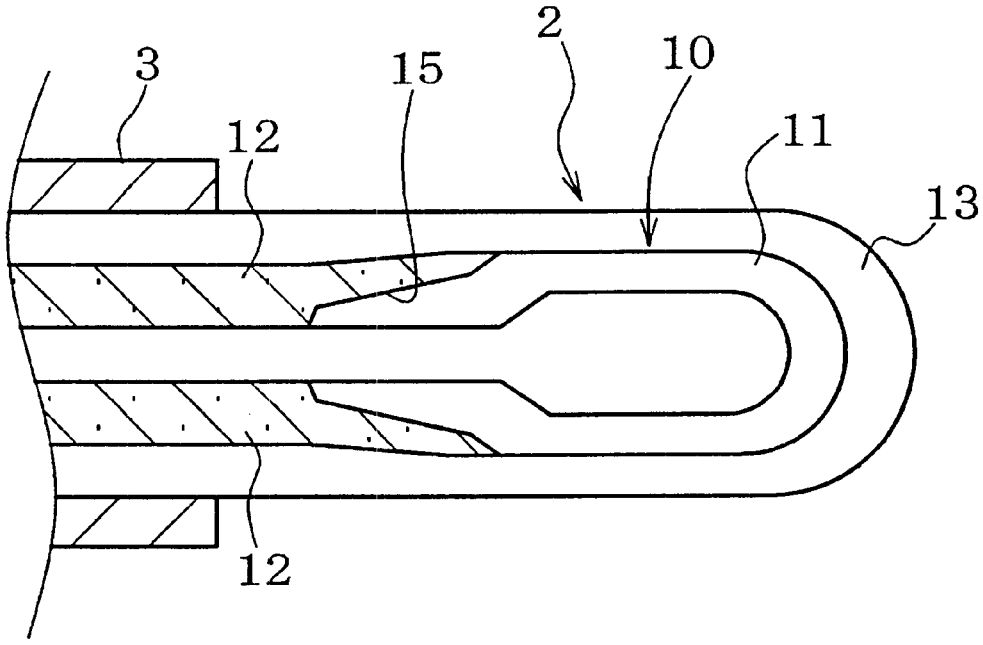
FIG. 10 is a sectional view showing a second modification of the front end portion.

As shown in FIGS. 2 and 4, the inclined face portion 15*t* of the joint interface 15 of the ceramic resistor 10 is perpendicular to the aforementioned reference plane K (which is parallel to the drawing sheet of FIG. 4). The inclined face portion 15*t* can be inclined in either of the following two directions. As shown in FIG. 9, the first resistor portion 11 and the second resistor portion 12 are in contact with each other at the inclined face portion 15*t* such that the first resistor portion 11 is disposed on the outer side of the second resistor portion 12 in the radial direction R with respect to the axis O of the heater body 2. And as shown in FIG. 10, the second resistor portion 12 is disposed on the outer side of the first resistor portion 11 in the radial direction R. Particularly, when the arrangement of FIG. 9 is employed, an end part of the first resistor portion 11, which has a large heating value, is located closer to the metallic sleeve 3, which exhibits good heat transfer, thereby accelerating heat release in the vicinity of the joint interface 15 of the ceramic resistor 10. As a result, a temperature gradient in the vicinity of the joint interface 15, which is prone to insufficient joining strength, is alleviated, whereby a problem in that thermal stress excessively concentrates on the joint interface 15 can be avoided more readily.

Figure 11:
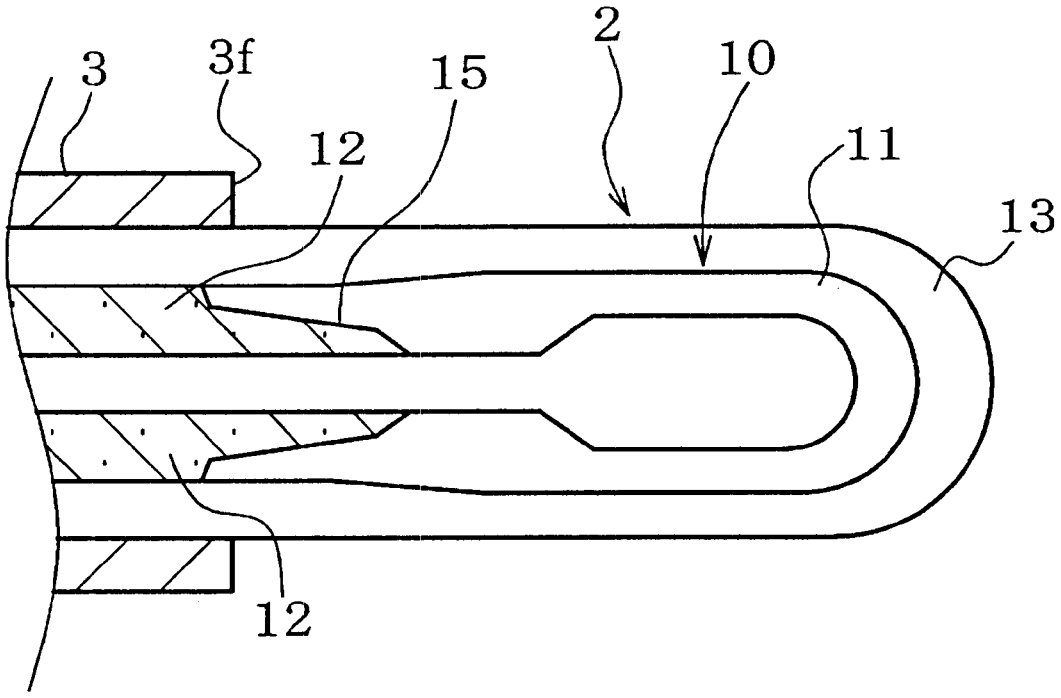
FIG. 11 is a sectional view showing a third modification of the front end portion.
Figure 12:
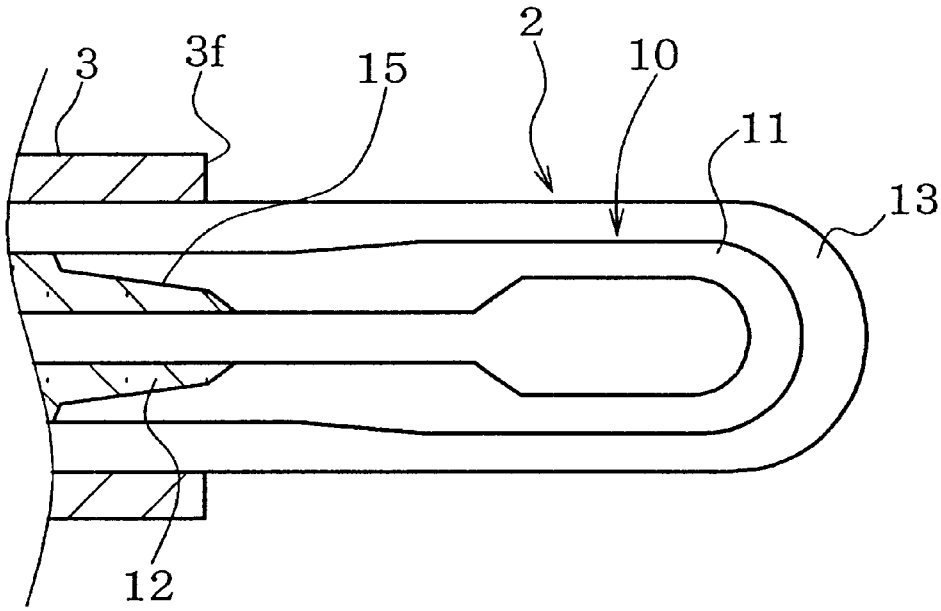
FIG. 12 is a sectional view showing a fourth modification of the front end portion.

As shown in FIGS. 11 and 12, when the ceramic resistor 10 is configured such that the joint interface 15 between the first resistor portion 11 and the second resistor portion 12 is located partially (FIG. 11) or entirely (FIG. 12) rearward from a front end edge 3*f* of the metallic sleeve 3 as viewed along the direction of the axis O of the metallic sleeve 3, an end part of the first resistor portion 11 is covered with the metallic sleeve 3, whereby the above-mentioned heat release effect is enhanced. As shown in FIG. 11, when the joint interface 15 is partially located within the metallic sleeve 3, the heat generated by the first resistor portion 11 is not excessively released to the metallic sleeve 3, whereby the heat generation efficiency of the ceramic heater 1 is favorably maintained at a good level.

Figure 5:
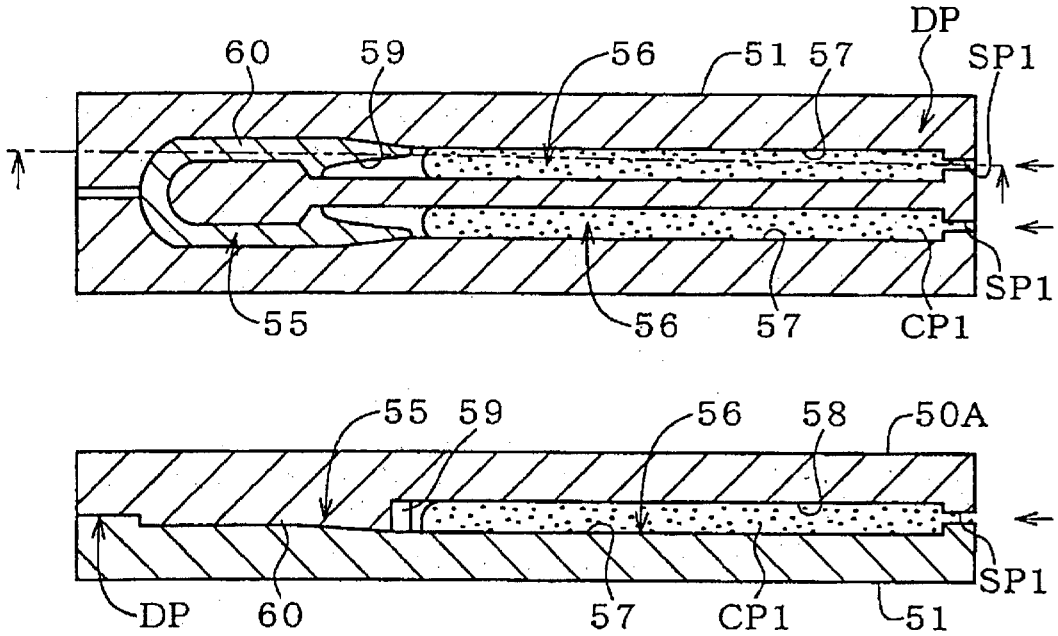
FIGS. 5(*a*)–5(*b*) are explanatory views showing an example of a process for forming a resistor green body of the glow plug of FIG. 1 through insert molding.
Figure 5:
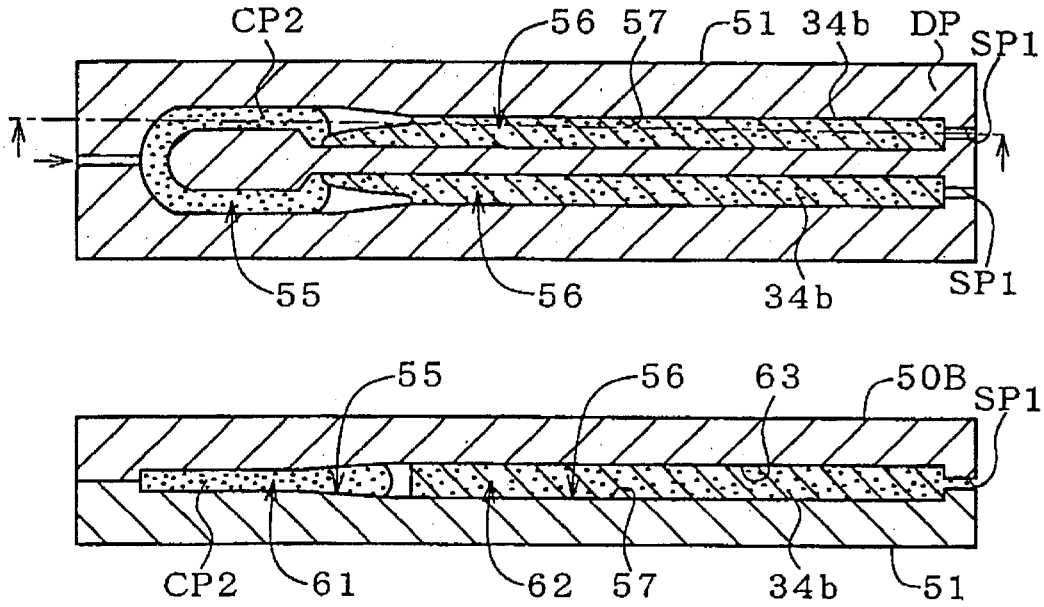

A method for manufacturing the ceramic heater 1 (heater body 2) will next be described. First, a resistor green body 34 (FIG. 6), which eventually becomes the ceramic resistor 10, is formed by injection molding, specifically, insert molding. FIG. 5 shows an example of a molding process in which a split mold having an injection cavity is used for molding the resistor green body 34. The split mold is composed of a first mold 50A or 50B and a second mold 51. The injection cavity is divided into a cavity formed in the first mold 50A or 50B and a cavity formed in the second mold 51, along a dividing plane DP corresponding to the reference plane K.

The second mold 51 has a second integral injection cavity 57 formed therein. The second integral injection cavity 57 is integrally composed of a cavity 55 for molding the first resistor portion 11 (FIG. 2), and a cavity 56 for molding the second resistor portions 12 (FIG. 2). A preliminary-molding mold 50A and an insert-molding mold 50B are prepared to serve as the first mold. The preliminary-molding mold 50A has a partial injection cavity 58 formed therein for molding a preliminary green bodies 34*b,* which become the second resistor portions 12. The preliminary-molding mold 50A includes a filler portion 60 that fills a portion 55 of the second integral injection cavity 57, when the preliminary-molding mold 50A is mated with the second mold 51. The cavity portion 55 is not used for molding the preliminary green bodies 34*b*. The filler portion 60 has an adjacent face 59 adjacent to the partial injection cavity 58 and perpendicular to the dividing plane DP. The insert-molding mold 50B has a first integral injection cavity 63 formed therein. The first integral injection cavity 63 is integrally composed of a cavity 61 for molding the first resistor portion 11 (FIG. 2), and a cavity 62 for molding the second resistor portions 12 (FIG. 2).

First, as shown in FIG. 5(*a*), the second mold 51 and the preliminary-molding mold 50A are mated with each other, and a molding compound CP1 is injected to thereby mold the preliminary green bodies 34*b*. The molding compound CP1 is prepared by the steps of mixing a tungsten carbide powder, a silicon nitride powder, and a sintering aid powder so as to obtain the composition of the second electrically conductive ceramic, thereby yielding a ceramic powder material; kneading a mixture of the ceramic powder material and an organic binder to obtain a compound; and fluidizing the compound through application of heat.

Upon completion of injection molding of the preliminary green bodies 34*b,* the split mold is opened. Since the joint interface 15 between the first resistor portion 11 and the second resistor portion 12 is only formed of planes perpendicular to the reference plane K (i.e., the dividing plane DP), the split mold can be readily opened without inflicting damage to the preliminary green bodies 34*b,* by separating the preliminary-molding mold 50A from the second mold 51 in the direction perpendicular to the dividing plane DP.

Next, as shown in FIG. 5(*b*), the second mold 51 and the insert-molding mold 50B are mated with each other while the preliminary green bodies 34*b* are disposed as inserts in the corresponding cavity portions 56 and 62 of the first integral injection cavity 63 and the second integral injection cavity 57. A molding compound CP2 is injected into the remaining cavity portions 55 and 61 to thereby yield the resistor green body 34 through integration of an injection-molded portion 34*a* (FIG. 6) with the preliminary green bodies 34*b*. The molding compound CP2 is similar to the molding compound CP1; however, a powder material for the molding compound CP2 is blended so as to obtain the composition of the first electrically conductive ceramic. While the preliminary green bodies 34*b* obtained in the step of FIG. 5(*a*) are left in the second mold 51, the preliminary-molding mold 50A is replaced with the insert-molding mold 50B, followed by insert molding with the molding compound CP2, whereby working efficiency is further enhanced.

The molding sequence of the first resistor portion 11 and the second resistor portions 12 can be reversed. In this case, a preliminary-molding mold must include a filler portion which fills the cavity portion 56 of the second integral injection cavity 57. In the present embodiment, as shown in FIG. 2, the first resistor portion 11 is smaller in dimension as measured along the direction of the axis O than the second resistor portions 12. In this case, in manufacture of the resistor green body 34, the preliminary green bodies 34*b* correspond to the second resistor portions 12, thereby yielding the following advantage. When portions corresponding to the second resistor portions 12 are to be injection-molded, as shown in FIG. 5(*a*), forming sprues SP1 for injecting a compound therethrough at a longitudinally rear end portion of the cavity is favorable for uniform injection of the molding compound CP1 into the cavity. At this time, when the second resistor portions 12 are long, the moving distance of the fluidized molding compound CP1 becomes considerably long. As a result, until the molding compound CP1 reaches the joint interface position, the temperature of a molten binder unavoidably drops to a certain extent. However, since the dimension of the first resistor portion 11 is small, the moving distance of the fluidized molding compound CP2 is short, and therefore temperature drop becomes unlikely. Thus, when two green bodies are to be integrated at the joint interface through insert molding, the insert molding process of the present embodiment (in which the first resistor portion 11 is molded while the previously molded second resistor portions 12 are used as inserts) allows the molding compound CP2 to reach the joint interface at higher temperature, thereby providing a strong joint with few defects.

Figure 6:
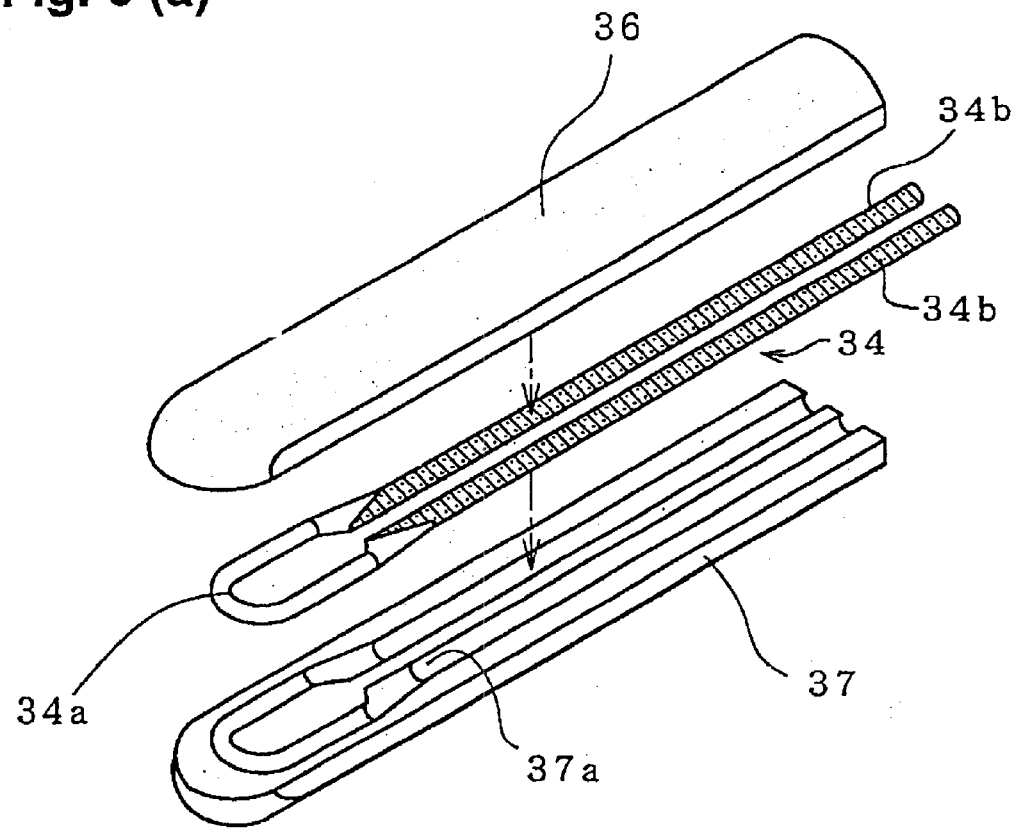
FIGS. 6(*a*)–6(*b*) are explanatory views showing a process for forming a ceramic heater by use of the resistor green body of FIG. 5.
Figure 6:
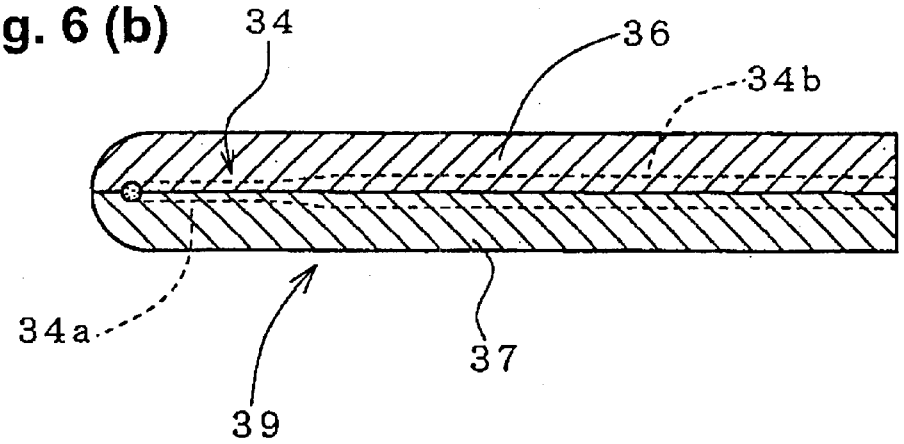
Figure 7:
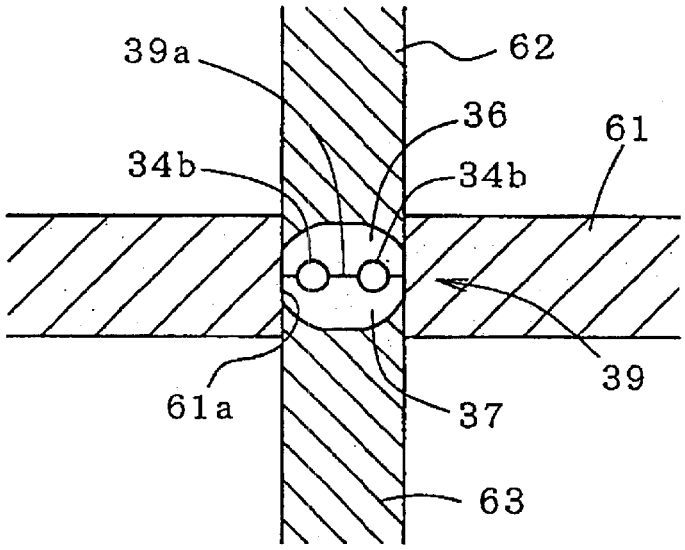
FIGS. 7(*a*)–7(*b*) are explanatory views showing a process subsequent to that of FIG. 6.
Figure 7:
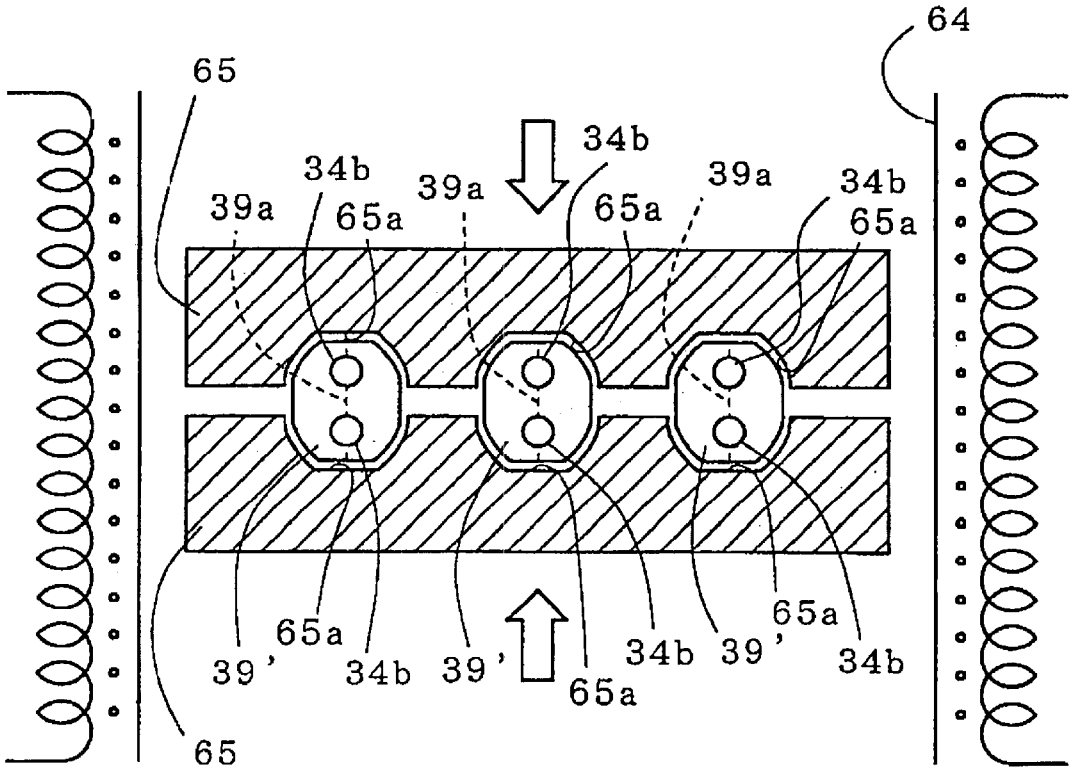

In relation to the above-described formation of the resistor green body 34, a powder material for forming the ceramic substrate 13 is die-pressed beforehand into half green bodies 36 and 37, which are upper and lower substrate green bodies formed separately, as shown in FIG. 6(*a*). A recess 37*a* having a shape corresponding to the resistor green body 34 is formed on the mating surface of each of the half green bodies 36 and 37. The recess 37*a,* which is formed on the half green body 36, is not shown in FIG. 6(*a*). Next, the half green bodies 36 and 37 are joined together at the above-mentioned mating surfaces, while the resistor green body 34 is accommodated in the recesses 37*a*. Then, as shown in FIG. 7(*a*), an assembly of the half green bodies 36 and 37 and the resistor green body 34 is placed in a cavity 61*a* of a die 61. The assembly is then pressed by means of punches 62 and 63, thereby obtaining a composite green body 39 as shown in FIG. 6(*b*).

To remove a binder component and the like, the thus-obtained composite green body 39 is calcined at a predetermined temperature (e.g., approximately 600° C.) to thereby become a calcined body 39', as shown in FIG. 6(*b*). It is to be appreciated that a calcined body is considered a composite green body in the broad sense. Subsequently, as shown in FIG. 7(*b*), the calcined body 39' is placed in cavities 65*a* of hot-pressing dies 65 made of graphite or a like material.

As shown in FIG. 7(*b*), the calcined body 39' held between the pressing dies 65 is placed in a kiln 64. In the kiln 64, the calcined body 39' is sintered at a predetermined firing retention temperature (not lower than 1700° C.; e.g., about 1800° C.) in a predetermined atmosphere while being pressed between the pressing dies 65, to thereby become a sintered body 70 as shown in FIG. 8(*c*).

Figure 8:
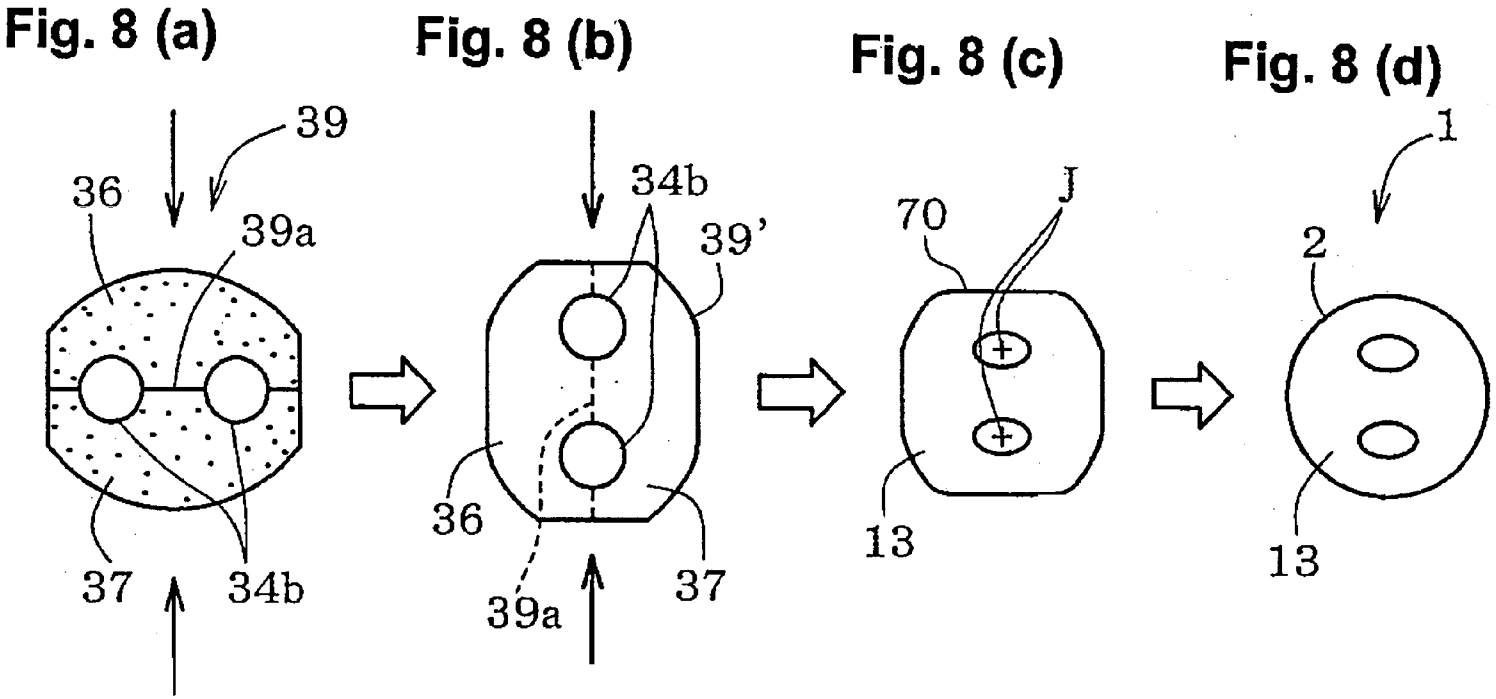
FIGS. 8(*a*)–8(*d*) are enlarged sectional views showing a front end portion of a heater body of FIG. 1.

In the firing process described above, the calcined body 39' shown in FIG. 7(*b*) is fired while being compressed in the direction along the mating surface 39*a* of the half green bodies 36 and 37, to thereby become the sintered body 70 as shown in FIG. 8(*c*). In FIG. 8(*b*), the preliminary green bodies 34*b* of the resistor green body 34 are deformed such that the circular cross sections thereof are squeezed along the above-mentioned direction of compression (i.e., the direction along which the axes J approach each other), to thereby become the second resistor portions 12 each having an elliptic cross section.

The external surface of the thus-obtained sintered body 70 of FIG. 8(*c*) is, for example, polished such that the cross section of the ceramic substrate 13 assumes a circular shape as shown in FIG. 8(*d*), thereby yielding the final heater body 2 (ceramic heater 1). Necessary components, such as the metallic sleeve 3, the electricity-conduction terminal elements 16 and 17, and the metallic shell 4, are attached to the ceramic heater 1, thereby completing the glow plug 50 shown in FIG. 1.

Figure 15:
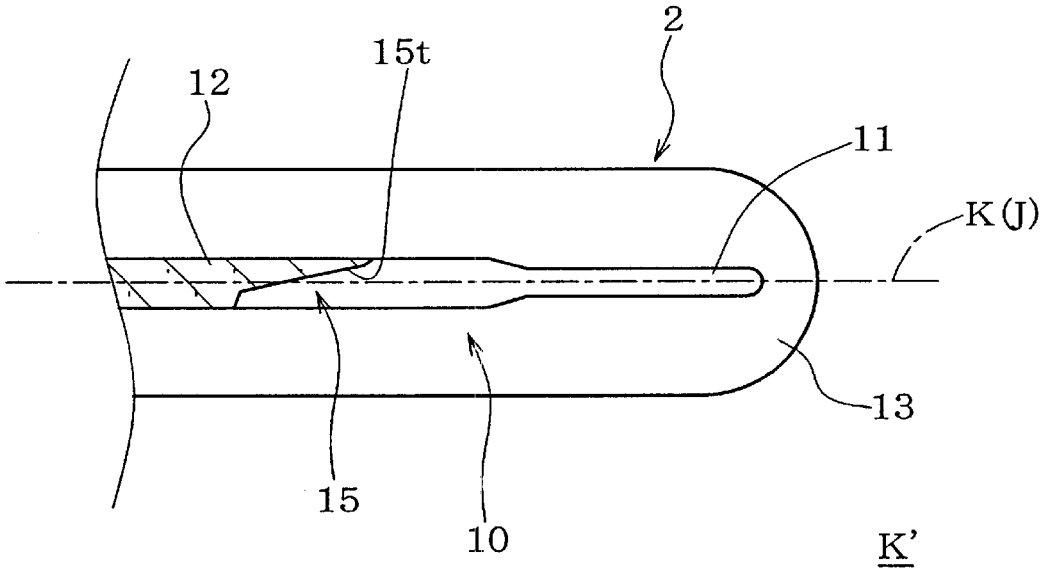
FIG. 15 is a sectional view showing a seventh modification of the front end portion.

To simultaneously achieve the two objects of the present invention, the ceramic heater 1 to be used in the glow plug 50 shown in FIGS. 1 and 2 is configured, such that the joint interface 15 of the ceramic resistor 10 is only formed of the planes 15*t* and 15*e* perpendicularly intersecting the reference plane K (achievement of the first object), and such that a portion of the joint face 15 assumes the form of the inclined face portion 15*t* (achievement of the second object). However, when achievement of either one the first or second objects suffices, the requirements which the ceramic heater 1 must fulfill can be selectively employed as needed. For example, as shown in FIG. 15, the joint interface 15 can include the inclined face portion 15*t,* which is inclined with respect to the reference plane K. In this case, through formation of the inclined face portion 15*t,* the second object can be achieved. In this case, a plane on which the aforementioned crossing angle θ is determined can be defined as a plane K' including the axis J and perpendicularly intersecting the reference plane K.

Figure 3:
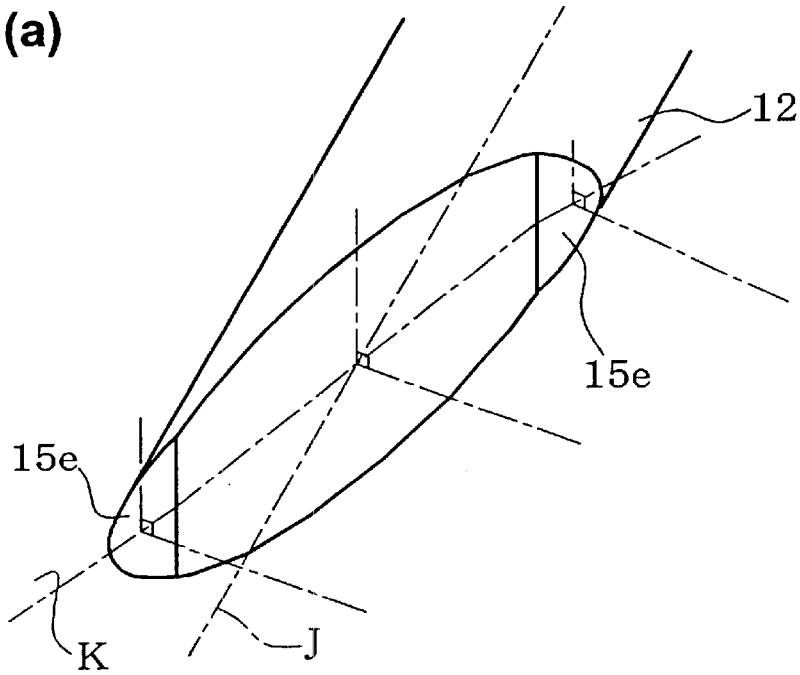
FIGS. 3(*a*)–3(*c*) are perspective views showing various forms of a joint interface.
Figure 3:
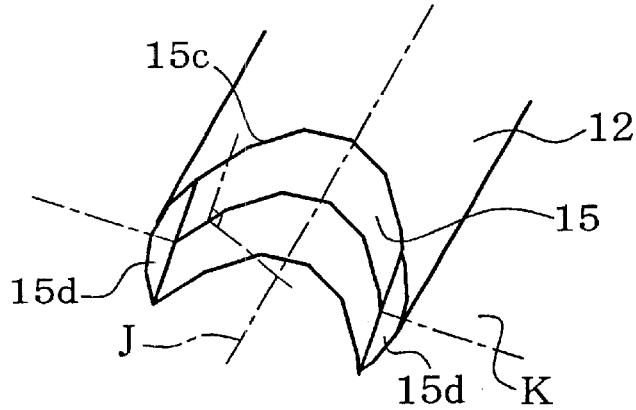
Figure 3:
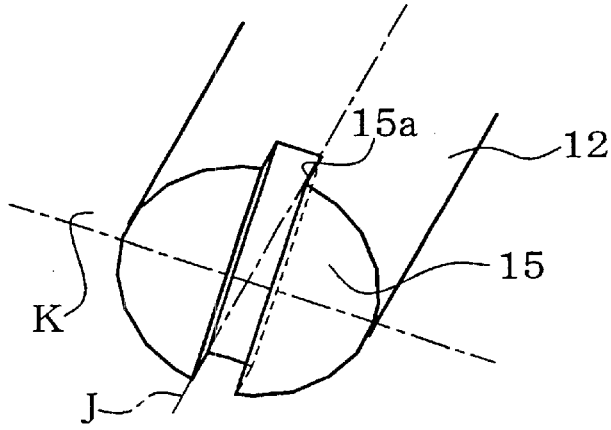
Figure 13:
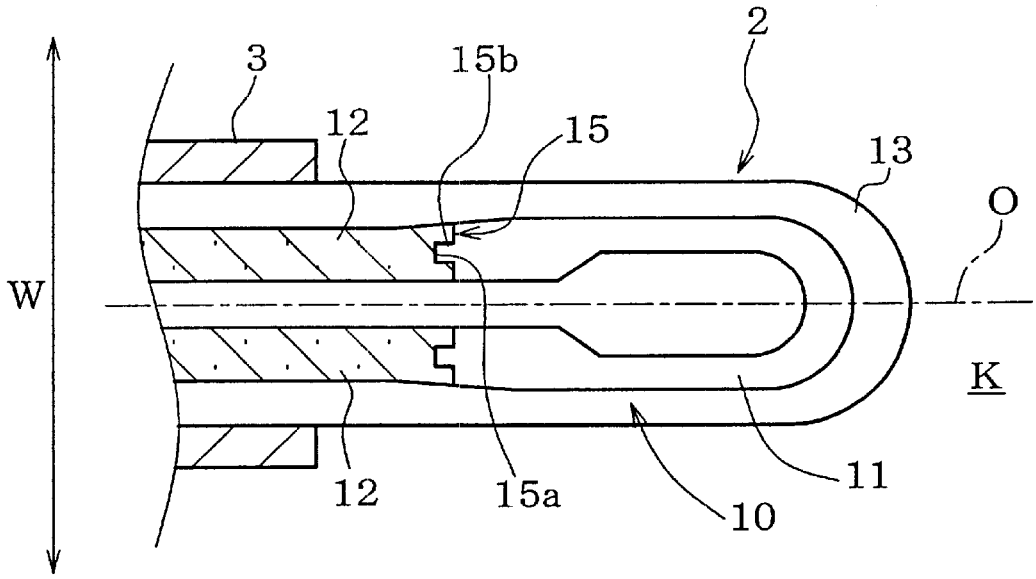
FIG. 13 is a sectional view showing a fifth modification of the front end portion.
Figure 14:
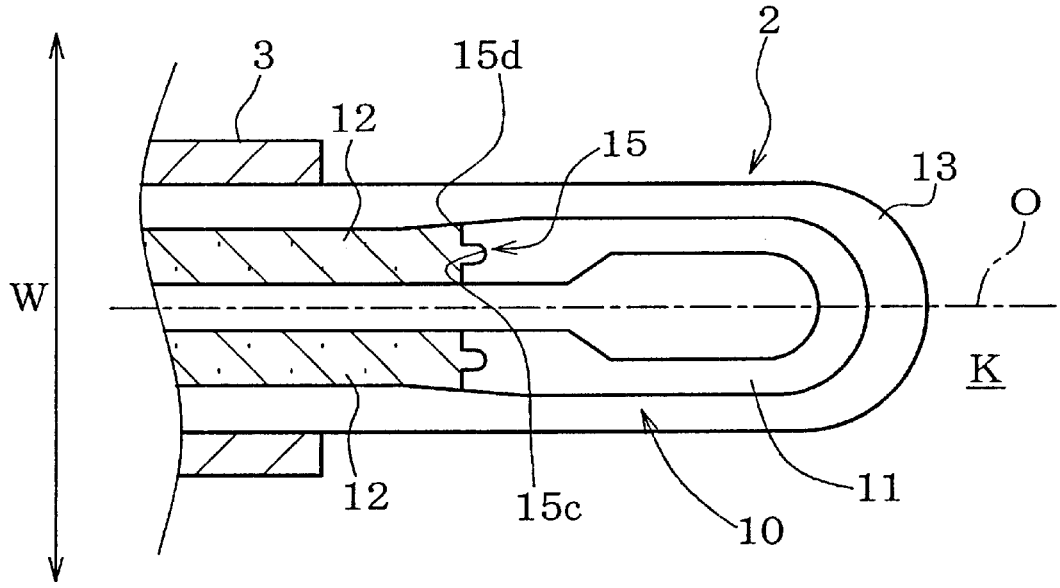
FIG. 14 is a sectional view showing a sixth modification of the front end portion.

As shown in FIGS. 13 and 14, a ceramic heater can be configured in such a manner as to merely fulfill the requirements for achievement of the first object only. According to the example shown in FIG. 13, a groove 15*a* perpendicularly intersecting the reference plane K is formed on either the first resistor portion 11 or the second resistor portions 12 (on the second resistor portions 12 in the present embodiment), whereas a protrusion 15*b*, which perpendicularly intersects the reference plane K and is engaged with the groove 15*a*, is formed on the other (on the first resistor portion 11 in the present embodiment). FIG. 3(*c*) is a perspective view schematically showing the joint interface 15 on the second resistor portion 12 (on which the groove 15*a* is formed). FIG. 14 shows an example in which the joint interface 15 includes a curved surface 15*c* perpendicularly intersecting the reference plane K, and FIG. 3(*b*) is a perspective view showing the joint interface 15 on the second resistor portion 12. Notably, plane portions 15*d* for dulling the crossing angle θ are formed at the corresponding opposite end portions of the curved surface 15*c*.

The ceramic heaters shown in FIGS. 13 and 14 can be considered as being configured in the following manner. The direction that is parallel to the reference plane K (see FIG. 3) and perpendicular to the axis O (in FIG. 3, the axis J may serve as the axis O) is defined as the width direction W. The joint interface 15 between the first resistor portion 11 and each of the second resistor portions 12 is shaped such that a portion 15*c* located at a middle position along the width direction W projects beyond the residual portion into the side toward the first resistor portion 11 (FIG. 14) or the side toward the second resistor portion 12 (FIG. 13). The thus-shaped joint interface 15 further enhances the joined state between the first resistor portion 11 and the second resistor portions 12.

Figure 16:
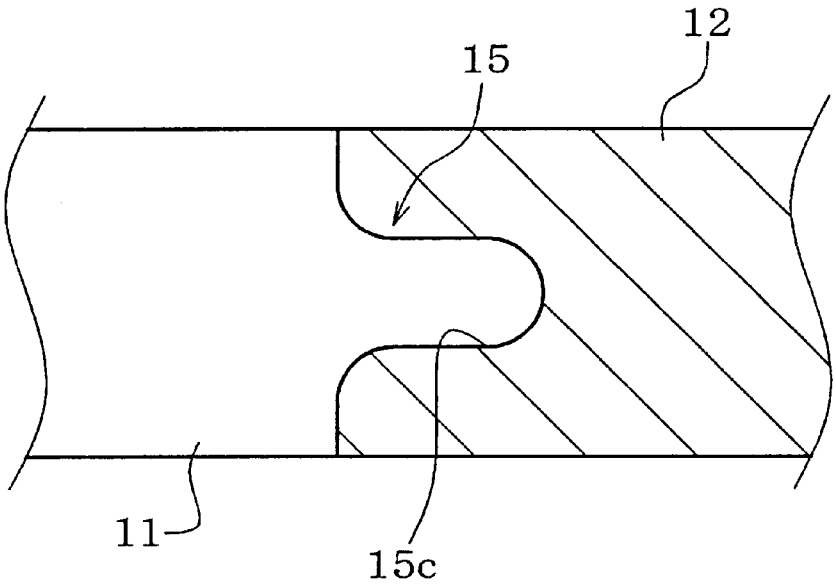
FIGS. 16(*a*)–16(*b*) are explanatory views showing a portion of a first modified example of a process for forming the resistor green body of FIG. 5 through insert molding.
Figure 16:
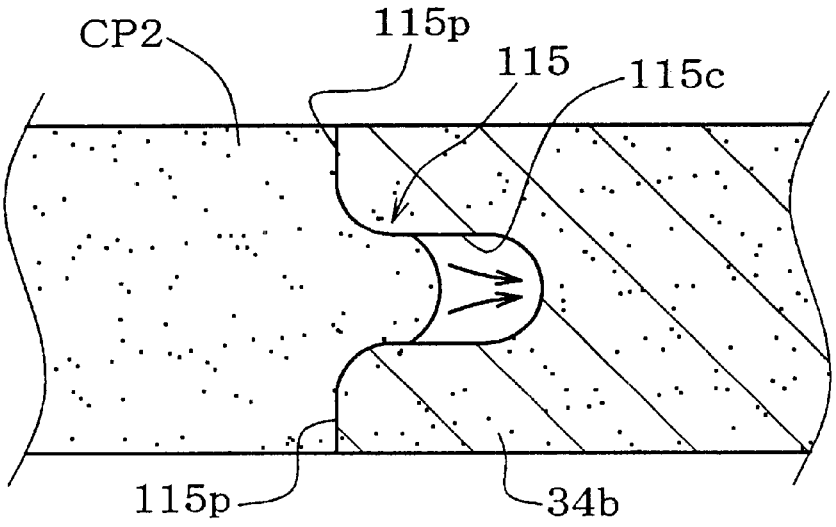

In this case, the following manufacturing process is particularly effective. In FIG. 16(*a*), the joint interface 15 is shaped such that the portion 15*c* located at a middle position along the width direction W projects beyond the residual portion into the side toward the second resistor portion 12. As shown in FIG. 16(*b*), a prospective joint interface 115 of the preliminary green body 34*b* with the injection-molded portion 34*a* has a recess 115*c* formed therein at a middle position along the width direction. The molding compound CP2 is filled into the recess 115*c* to thereby integrate the injection-molded portion 34*a* with the preliminary green body 34*b*. This process is similar to that which has been described previously with reference to FIG. 5, except that the prospective joint interface 115 is employed in place of the adjacent face 59. In the course of integrating the injection-molded portion 34*a* with the preliminary green body 34*b*, the molding compound CP2 comes into contact with end regions 115*p* located at opposite end portions of the recess 115*c* of the prospective joint interface 115, and is then filled into the interior of the recess 115*c*. A portion of the molten molding compound CP2 which is filled into the interior of the recess 115*c* tends to drop in temperature more than a portion which comes into contact with the end regions 115*p*. As a result, in some cases, a defective portion which exhibits incomplete joining to the preliminary green body 34*b* may be formed within the recess 115*c*. However, in the end regions 115*p*, which the molding compound CP2 of relatively high temperature comes into contact with, formation of such a defect is restrained. Therefore, even when a defect is present within the recess 115*c*, the defect is confined by the end regions 115*p*, which are hardly defective. As a result, a defect, which would otherwise become a starting point of a fracture, is not likely to become exposed on the surface of the resistor green body 34, and thus on the surface of the ceramic resistor 10 obtained through firing of the resistor green body 34, whereby the joining strength is enhanced.

Figure 17:
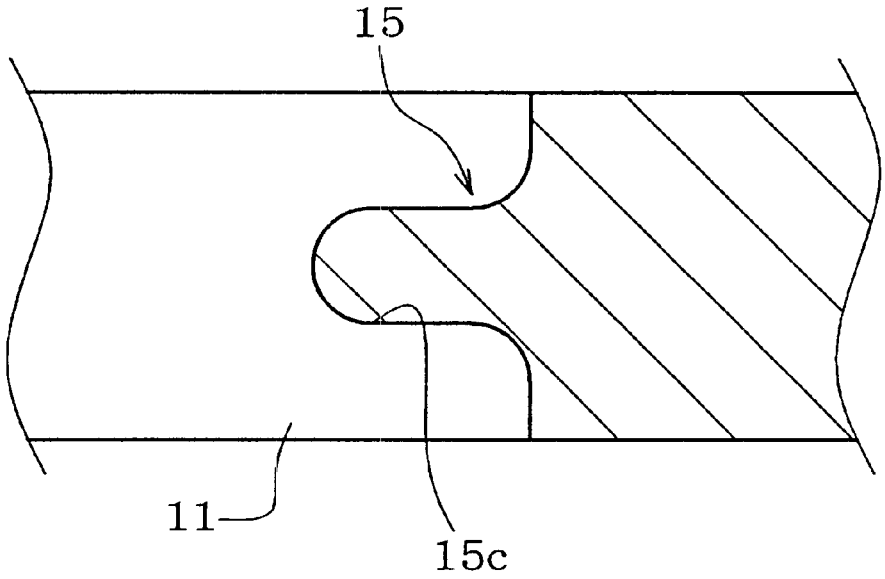
FIGS. 17(*a*)–17(*b*) are explanatory views showing a portion of a second modified example of a process for forming the resistor green body of FIG. 5 through insert molding.
Figure 17:
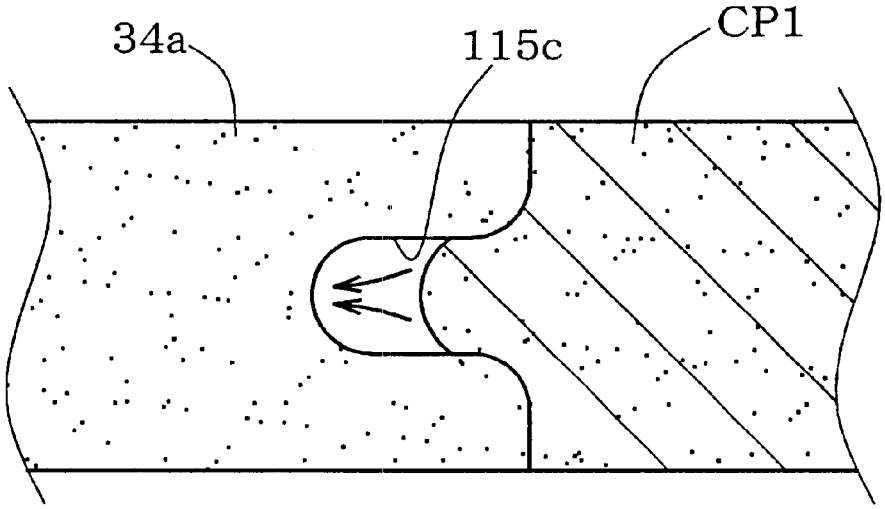

FIG. 17(*a*) shows an example in which the portion 15*c* of the joint interface 15 located at a middle position along the width direction W projects beyond the residual portion into the side toward the first resistor portion 11. In this case, the resistor green body 34 is formed in such a manner as to include the preliminary green body 34*a* corresponding to the first resistor portion 11. Therefore, as shown in FIG. 17(*b*), in the course of integrating the preliminary green body 34*a* with the injection-molded portions corresponding to the second resistor portions 12 through insert molding, the recess 115*c*, which is formed in the preliminary green body 34*a*, is filled with the molding compound CP1.

Figure 18:
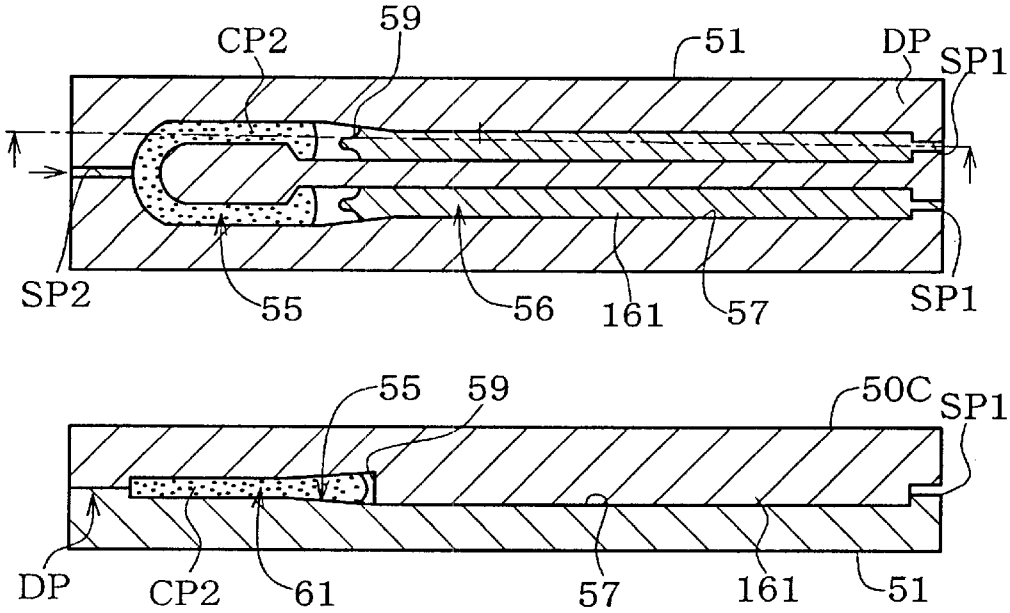
FIGS. 18(*a*)–18(*b*) are views showing a specific embodiment for carrying out the process of FIG. 17.
Figure 18:
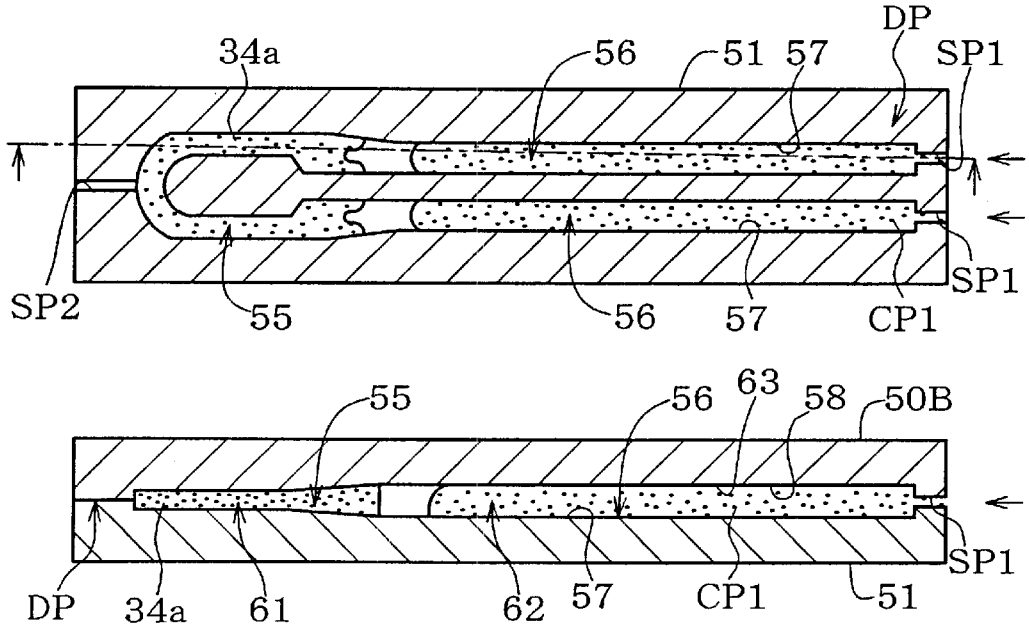

FIG. 18 shows an example of a specific manufacturing process for manufacturing the resistor green body 34 of FIG. 17. As shown in FIG. 18(*a*), a preliminary-molding mold 50C includes a filler portion 161 for filling a portion 56 of the second integral injection cavity 57 when the preliminary-molding mold 50C is mated with the second mold 51. The cavity portion 56 is not used for molding the preliminary green body 34*a*. The adjacent face 59 assumes a shape corresponding to the joint interface 15 shown in FIG. 17(*b*). The insert-molding mold 50B is similar to that of FIG. 5.

The second mold 51 and the preliminary-molding mold 50C are mated with each other, and the molding compound CP2 is injected to thereby mold the preliminary green body 34*a*. Next, as shown in FIG. 18(*b*), the second mold 51 and the insert-molding mold 50B are mated with each other while the preliminary green body 34*a* is disposed as an insert in the cavity portions 55 and 61 of the first integral injection cavity 63 and the second integral injection cavity 57. The molding compound CP1 is injected into the remaining cavity portions 56 and 62 to thereby yield the resistor green body 34 through integration of the injection-molded portions 34*b* with the preliminary green body 34*a*.

This application is based on Japanese Patent Application No. 2001-135621 filed May 2, 2001, the disclosure of which is incorporated herein by reference in its entirety.

What is claimed is:

1. A ceramic heater (1) comprising:

a rod-shaped heater body (2) having a ceramic resistor (10), which is formed of an electrically conductive ceramic, embedded in a ceramic substrate (13), which is formed of an insulating ceramic, wherein the ceramic resistor (10) has a first resistor portion (11) that is disposed at a front end portion of the heater body (2) and is formed of a first electrically conductive ceramic, and second resistor portions (12) that are disposed on a rear side of the first resistor portion (11) so as to extend along a direction of an axis (O) of the heater body (2), each of the second resistor portions (12) having a front end part joined to an end part of the first resistor portion (11) and being formed of a second electrically conductive ceramic, the second electrically conductive ceramic having an electrical resistivity that is lower than an electrical resistivity of the first electrically conductive ceramic, and wherein at least a portion of a joint interface (15) between the first resistor portion (11) and each of the second resistor portions (12) deviates from a transverse plane (P) perpendicularly intersecting the axis (O) of the heater body (2), and the joint interface (15) includes one of a plane (15*t*, 15*e*, 15*d*), a curved surface (15*c*), and a combination thereof (15*c*, 15*d*) perpendicularly intersecting a reference plane (K) that is coincident with the axis (O) of the heater body (2) and an axis (J) of the corresponding second resistor portion (12).

2. The ceramic heater (1) as claimed in claim 1, wherein a rear end part of each of the second resistor portions (12)

forms an exposed part (12*a*) that is exposed from a surface of the heater body (2), and the exposed part (12*a*) serves as a joint region where an electricity-conduction terminal element is joined to the ceramic resistor (10).

3. The ceramic heater (1) as claimed in claim 2, wherein the ceramic substrate (13) has a cut portion (13*a*) where the rear end parts of the second resistor portions (12) are exposed.

4. The ceramic heater (1) as claimed in claim 1, wherein a width direction is defined as being parallel to the reference plane (K) and perpendicular to the axis (O) of the heater body (2), and the joint interface (15) between the first resistor portion (11) and each of the second resistor portions (12) is shaped such that a projecting portion (15*c*) of the joint interface, which is located at a middle position along the width direction, projects beyond a residual portion of the joint interface toward one of the first resistor portion (11) and the second resistor portion (12).

5. The ceramic heater (1) as claimed in claim 1, wherein the joint interface (15) comprises an inclined face portion (15*t*), which is inclined with respect to the transverse plane (P) perpendicularly intersecting the axis (O) of the heater body (2).

6. The ceramic heater (1) as claimed in claim 5, wherein the first resistor portion (11) and the second resistor portions (12), which are in contact with each other at the inclined face portion (15*t*), are disposed such that the first resistor portion (11) is located on the outer side of the second resistor portion (12) in a radial direction with respect to the axis (O) of the heater body (2).

7. A ceramic heater (1) as described in claim 1, wherein a joint portion of the ceramic resistor (10) between the first resistor portion (11) and the second resistor portion (12) is arranged, such that S/S0 is not less than 1.2 and not greater than 10, where S is a total area of the joint interface (15) and S0 is a smallest area of transverse cross sections that perpendicularly intersect the axis (O) of the heater body (2) at arbitrary positions.

8. The ceramic heater (1) as claimed in claim 1, wherein a crossing angle θ between an outline of the ceramic resistor (10) and a line representing the joint interface, as measured on a section taken along an arbitrary plane (K or K'), which is coincident with the axis (J) of the corresponding second resistor portion (12), and which minimizes the angle θ, is not less than 20° and not greater than 90°.

9. A glow plug (50) comprising:

the ceramic heater (1) as claimed in claim 1;

a metallic sleeve (3) circumferentially surrounding the heater body (2) of the ceramic heater (1), such that a front end portion of the heater body (2) projects from the metallic sleeve (3) along the direction of the axis (O); and a metallic shell (4) joined to a rear end portion of the metallic sleeve (3), and having a mounting portion (5) formed on an outer circumferential surface thereof, the mounting portion (5) being adapted to mount the glow plug (50) onto an internal combustion engine.

10. The glow plug (50) as claimed in claim 9, wherein the ceramic resistor (10) is configured such that the joint interface (15) between the first resistor portion (11) and each of the second resistor portions (12) is partially located rearward from a front end edge (3*f*) of the metallic sleeve (3).

11. The method for manufacturing the ceramic heater as claimed in claim 1, comprising:

manufacturing a ceramic green body (39) and firing the ceramic green body (39) to manufacture the heater body (2), the ceramic green body (39) comprising a green body (36, 37) which is to become the ceramic substrate (13), and a resistor green body (34) which is embedded in the green body (36, 37) and is to become the ceramic resistor (10);

injection molding the resistor green body (34), and to carry out the injection molding, a split mold having an injection cavity for molding the resistor green body (34) is prepared, the split mold comprising a first mold (50A, 50B) and a second mold (51), the injection cavity being divided into a cavity formed in the first mold (50A, 50B) and a cavity formed in the second mold (51) along a dividing plane (DP) corresponding to the reference plane (K);

the second mold (51) has a second integral injection cavity (57) formed therein, the second integral injection cavity (57) integrally comprising a cavity (55) corresponding to the first resistor portion and cavities (56) corresponding to the second resistor portions, and a preliminary-molding mold (50A, 50C) and an insert-molding mold (50B) are prepared to serve as the first mold (50A, 50B), the preliminary-molding mold (50A, 50C) having a partial injection cavity (58, 61) formed therein for molding a preliminary green body (34*b*, 34*a*), which is to become either the first resistor portion (10) or the second resistor portions (12), the preliminary-molding mold (50A, 50C) comprising a filler portion (60, 161) for filling, when mated with the second mold (51), a portion (55, 56) of the second integral injection cavity (57) which is not used for molding the preliminary green body (34*b*, 34*b*, 34*a*), the filler portion (60, 161) having an adjacent face (59) adjacent to the partial injection cavity (58, 61) and perpendicular to the dividing plane (DP), the insert-molding mold (50B) having a first integral injection cavity (63) formed therein, the first integral injection cavity (63) integrally comprising a cavity (61) corresponding to the first resistor portion and cavities (62) corresponding to the second resistor portions;

mating together the second mold (51) and the preliminary-molding mold (50A, 50C), and injecting a molding compound (CP1, CP2) to thereby mold the preliminary green body (34*b*, 34*b*, 34*a*); and mating together the second mold (51) and the insert-molding mold (50B), while the preliminary green body (34*b*, 34*b*, 34*a*) is disposed as an insert in the corresponding cavity portions (56, 62, 55, 61) of the first integral injection cavity (63) and the second integral injection cavity (57), and injecting a molding compound (CP2, CP1) into the remaining cavity portions (55, 61; 56, 62) to thereby yield the resistor green body (34) through integration of an injection-molded portion (34*a*, 34*b*, 34*b*) with the preliminary green body (34*b*, 34*b*, 34*a*).

12. The method for manufacturing a ceramic heater as claimed in claim 11, wherein the first resistor portion (11) is smaller in dimension as measured along the direction of the axis (O) of the heater body (2) than each of the second resistor portions (12), and in manufacture of the resistor green body (34), the preliminary green body (34*b*) corresponds to each of the second resistor portions (12).

13. The method for manufacturing a ceramic heater as claimed in claim 11, wherein, with a direction in parallel with the reference plane (K) and perpendicular to the axis (O) being defined as a width direction, a prospective joint interface (115) of the preliminary green body (34*b* or 34*a*)

with the injection-molded portion (34*a* or 34*b*) has a recess (115*c*) formed therein at a middle position along the width direction, and the molding compound (CP2 or CP1) is filled into the recess (115*c*) to thereby integrate the injection-molded portion (34*a* or 34*b*) with the preliminary green body (34*b* or 34*a*).

14. A ceramic heater (1) comprising:

a rod-shaped heater body (2) having a ceramic resistor (10), which is formed of an electrically conductive ceramic, embedded in a ceramic substrate (13), which is formed of an insulating ceramic, wherein the ceramic resistor (10) has a first resistor portion (11) that is disposed at a front end portion of the heater body (2) and is formed of a first electrically conductive ceramic, and second resistor portions (12) that are disposed on a rear side of the first resistor portion (11) so as to extend along a direction of an axis (O) of the heater body (2), each of the second resistor portions (12) having a front end part joined to an end part of the first resistor portion (11) and being formed of a second electrically conductive ceramic, the second electrically conductive ceramic having an electrical resistivity that is lower than an electrical resistivity of the first electrically conductive ceramic, and wherein a joint interface (15) between the first resistor portion (11) and each of the second resistor portions (12) includes an inclined face portion (15*t*), which is inclined with respect to a transverse plane (P) perpendicularly intersecting the axis (O) of the heater body (2).

15. The ceramic heater (1) as claimed in claim 14, wherein a joint portion of the ceramic resistor (10) between the first resistor portion (11) and the second resistor portion (12) is arranged, such that S/S0 is not less than 1.2 and not greater than 10, where S is a total area of the joint interface (15) and S0 is a smallest area of transverse cross sections that perpendicularly intersect the axis (O) of the heater body (2) at arbitrary positions.

16. The ceramic heater (1) as claimed in claim 14, wherein a crossing angle θ between an outline of the ceramic resistor (10) and a line representing the joint interface, as measured on a section taken along an arbitrary plane (K or K'), which is coincident with the axis (J) of the corresponding second resistor portion (12), and which minimizes the angle θ, is not less than 20° and not greater than 90°.

17. A glow plug (50) comprising:

the ceramic heater (1) as claimed in claim 14;

a metallic sleeve (3) circumferentially surrounding the heater body (2) of the ceramic heater (1), such that a front end portion of the heater body (2) projects from the metallic sleeve (3) along the direction of the axis (O); and a metallic shell (4) joined to a rear end portion of the metallic sleeve (3), and having a mounting portion (5) formed on an outer circumferential surface thereof, the mounting portion (5) being adapted to mount the glow plug (50) onto an internal combustion engine.

18. The glow plug (50) as claimed in claim 17, wherein the ceramic resistor (10) is configured such that the joint interface (15) between the first resistor portion (11) and each of the second resistor portions (12) is partially located rearward from a front end edge (3*f*) of the metallic sleeve (3).

* * * * *